US011337510B2

(12) United States Patent
Stevens

(10) Patent No.: US 11,337,510 B2
(45) Date of Patent: May 24, 2022

(54) PERSONAL EFFECTS HOLDER WITH RECEIVING FACE

(71) Applicant: Darryl Stevens, Buffalo Grove, IL (US)

(72) Inventor: Darryl Stevens, Buffalo Grove, IL (US)

( * ) Notice: Subject to any disclaimer, the term of this patent is extended or adjusted under 35 U.S.C. 154(b) by 94 days.

(21) Appl. No.: 16/792,686

(22) Filed: Feb. 17, 2020

(65) Prior Publication Data

US 2020/0260848 A1 Aug. 20, 2020

Related U.S. Application Data

(60) Provisional application No. 62/807,098, filed on Feb. 18, 2019.

(51) Int. Cl.
*A45F 5/02* (2006.01)
*A45F 5/00* (2006.01)

(52) U.S. Cl.
CPC ..... *A45F 5/02* (2013.01); *A45F 2005/002* (2013.01); *A45F 2200/0541* (2013.01)

(58) Field of Classification Search
CPC ..... A45F 5/02; A45F 2005/002; A45F 2200/0541
See application file for complete search history.

(56) References Cited

U.S. PATENT DOCUMENTS 1,609,347 A * 12/1926 Dee ..... A45F 5/02 24/3.6
1,718,433 A * 6/1929 Rivas ..... A45F 5/02 24/3.6
D248,341 S * 7/1978 Gillenwater ..... D3/221
4,638,530 A * 1/1987 Perry ..... A45F 5/02 224/904
5,103,884 A * 4/1992 Roman ..... A45F 5/02 150/134
5,249,437 A * 10/1993 Cole, Jr. ..... A44C 1/00 24/498
5,533,656 A * 7/1996 Bonaldi ..... A45C 1/04 224/667
5,845,369 A * 12/1998 Dunchock ..... G02C 11/00 24/3.3
6,260,749 B1 * 7/2001 Horovitz ..... A45F 5/02 206/5
6,367,126 B1 * 4/2002 Rivkin ..... A45F 5/02 24/10 R
6,533,414 B2 * 3/2003 Newler ..... G02C 3/04 224/251
6,688,505 B1 * 2/2004 Bradley ..... A45F 5/02 224/194
6,851,591 B2 * 2/2005 Wissman ..... A45F 5/02 224/245
8,739,368 B2 * 6/2014 Murphy, Jr. ..... A45F 5/02 24/3.3
D877,497 S * 3/2020 Stevens ..... D3/219
10,595,619 B2 * 3/2020 Cureington ..... A45C 13/1069
(Continued)

*Primary Examiner* — Robert Sandy
*Assistant Examiner* — Louis A Mercado

(57) ABSTRACT

Embodiments relate to a personal effects holder device. The holder device includes a first portion having a lip defining an aperture forming a holder portion adapted to receive one or more personal effects; and a depending second portion joined to the first portion via a connector portion, the second portion including a first catch and a second catch.

18 Claims, 50 Drawing Sheets

(56) References Cited

U.S. PATENT DOCUMENTS

| | | | | |
|---|---|---|---|---|
| D911,026 | S * | 2/2021 | Stevens | D3/265 |
| 2003/0113680 | A1* | 6/2003 | Genuise | F23Q 2/32<br>431/253 |
| 2008/0010782 | A1* | 1/2008 | Sturdy | A45F 5/02<br>24/3.3 |
| 2008/0265082 | A1* | 10/2008 | Angiuli | A45F 5/004<br>242/400 |
| 2012/0265714 | A1* | 10/2012 | Duval | F16B 2/22<br>705/500 |

* cited by examiner

PERSONAL EFFECTS HOLDER WITH RECEIVING FACE

CROSS-REFERENCE TO RELATED APPLICATIONS

This non-provisional patent application is related to and claims priority from U.S. Provisional Patent Application No. 62/807,098 filed Feb. 18, 2019, the complete subject matter of which is incorporated herein by reference.

This application is related to U.S. Design application Ser. No. 29/666,715 filed on Oct. 15, 2018, now U.S. Design Pat. No. D877.497 and U.S. Design application Ser. No. 29/685,147 filed on Mar. 26, 2019, now U.S. Design Pat. No. D911.026, each of which is incorporated herein by reference in its entirety.

FIELD OF THE INVENTION

One or more embodiments consistent with the present disclosure relate to personal effects holders, more specifically to a device adapted to hold personal effects, such as a pair of eyeglasses or other instruments, to an article of clothing of a user.

BACKGROUND

The disclosure provides a system and method for holding personal items and effects on an article of clothing for example.

Millions of people wear glasses, use pens, electronic devices, headsets, earpieces, and the like. However, many of them remove their glasses or other instruments during the course of the day for various reasons. In some cases, the glasses are used only for reading. In other cases, the glasses are needed only for seeing objects at a distance or used to block the sun's harmful rays, in addition to protecting the eyes from injury, safety glasses for example. In still other instances, individuals simply remove their glasses to perform other activities or to give their eyes a rest. In each case, the user requires a place to hold or store the glasses when they are not in use.

Glasses cases are commonly available, as are chains or strings which hang around the head or neck of a user and hold the glasses when they are removed from the user's head. Such chains are fully functional to hold glasses when not in use, but they frequently suffer from practical or aesthetic shortcomings which limit their use. Other solutions utilize holding devices such as magnets that may affect electronic or biometric devices and are a swallowing hazard to children. Individuals dressed in casual clothes frequently do not choose to carry glasses cases, and may, for aesthetic reasons, prefer not to use chains. Various improvisations may be made to hold and support glasses when not in use, though they frequently suffer from an inability to secure the glasses, are annoying, inconvenient or are aesthetically undesirable to many users.

Embodiments of the present invention address these and other deficiencies associated with contemporary eyeglasses holders. The present invention not only provides a device for securing eyeglasses against dislodgement by an active user, but also provides a more aesthetically pleasing construction that can appear as an ornamental device.

These and other objects, aspects, and advantages of the present disclosure will become better understood with reference to the accompanying description and claims.

SUMMARY

Embodiments of the invention relate to a holder device. One or more embodiments relate to a personal effects holder device. The device includes a first portion having a lip defining an aperture forming a holder portion adapted to receive one or more personal effects; and a depending second portion joined to the first portion via a connector portion, the second portion including a first catch and a second catch.

Yet another embodiment relates to a personal effects holder device. The device includes a body, a lip, a connector and a depending portion. The body includes a face adapted to display an indicia; an edge extending outward from and around at least portion of the face. The lip extends from body while the connector is joined to the body. The depending portion is joined to the connector and extends in a direction substantially parallel to the body and includes a first catch; and a second catch.

Still another embodiment relates to a personal effects holder device including a body, a lip, a connector and a member. The body includes a face adapted to display an insert, where the face has opposing first and second ends. The lip extends from the body proximate the first end. The connector is positioned proximate the second end, where the connector extends from the body in a generally different direction than the lip. The member is coupled to the connector and extends in a direction generally different from the both the lip and the connector.

Still another embodiment relates to a method of holding personal effects. The method includes removably securing a holding device to an article of clothing; removably holding the personal effects; and displaying an indicia.

The following U.S. patents are incorporated herein by reference in their entirety:

U.S. Pat. No. 5,845,369 A to Dunchock on Oct. 22, 1996;
U.S. Pat. No. 6,260,749 B1 to Horovitz on Jul. 17, 2001;
U.S. Pat. No. 6,367,126 B1 to Rivkin on Apr. 9, 2002;
U.S. Pat. No. 6,533,414 B2 to Newler on Mar. 18, 2003; and
U.S. Pat. No. 8,739,368 B2 to Murphy, Jr. on Jun. 3, 2014.

BRIEF DESCRIPTION OF THE DRAWINGS

These and other features, aspects, and advantages of the multiple embodiments of the present invention will become better understood with reference to the following description, appended claims, and accompanied drawings where:

DETAILED DESCRIPTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide description of a personal effects holder, and methods for using such personal effects holders.

Figure 1:
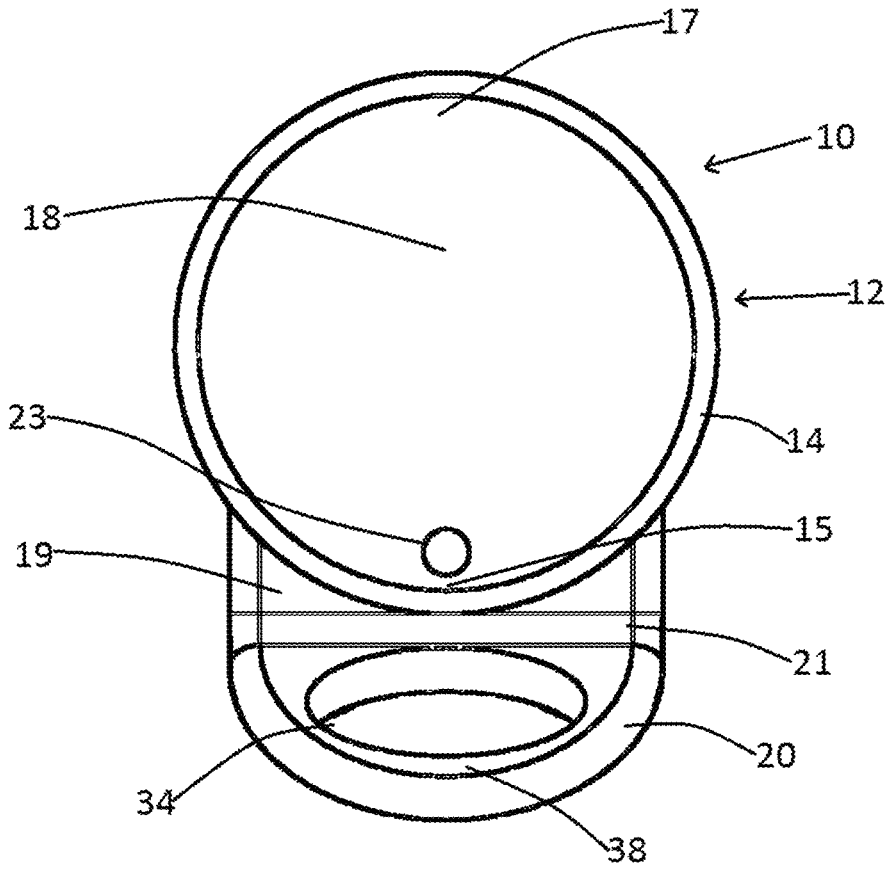
FIG. 1 depicts a front elevational view of one embodiment of a personal effects holder.
Figure 4:
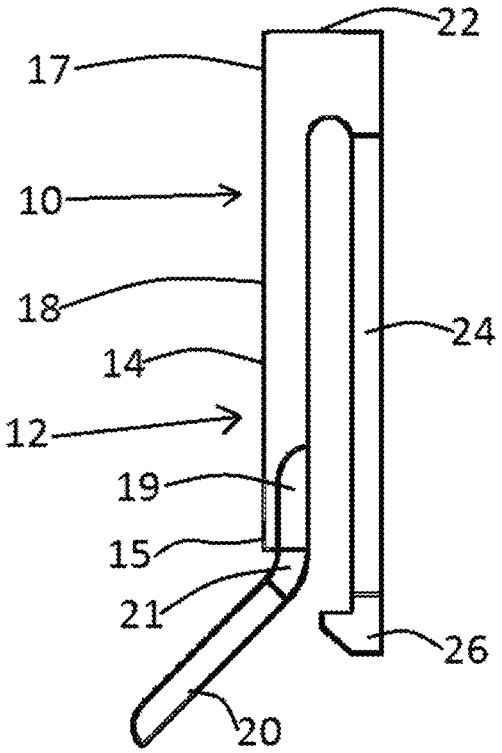
FIG. 4 depicts a right-side elevation view of the holder of FIG. 1.
Figure 5:
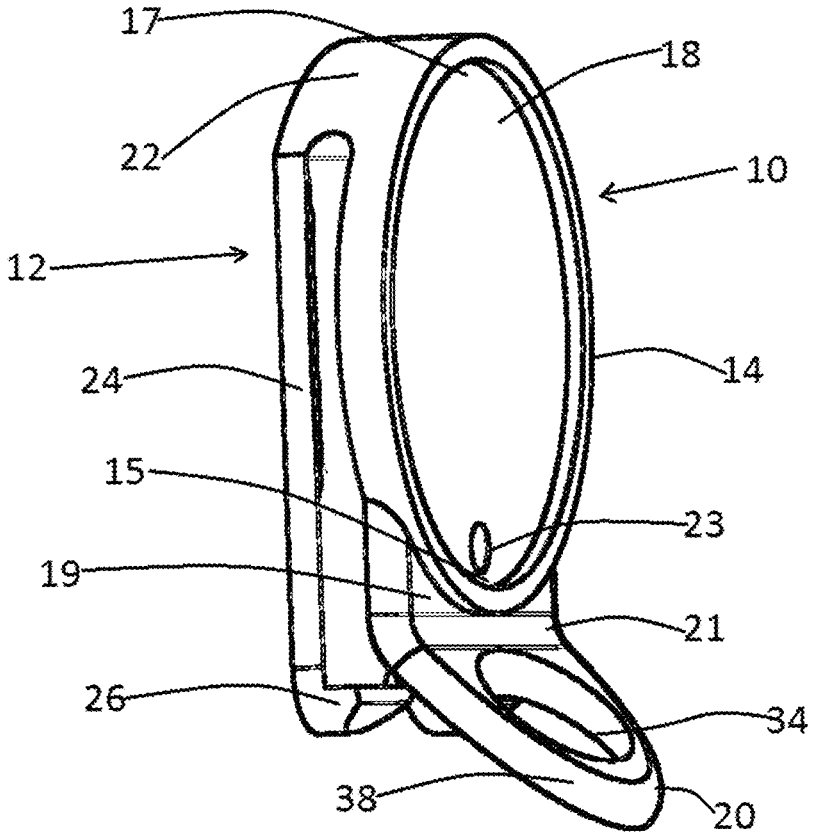
FIG. 5 depicts a perspective view of the holder of FIG. 1.

FIGS. 1 and 5 illustrate elevational and perspective views of one embodiment of the personal effects holder or clip, generally designated 10, and includes body 12 with edge 14 defining face or fascia 18. As illustrated, clip 10 has first end 15 and second end 17. In at least one embodiment, clip 10 includes extension 19 attached to and extending from body 12 proximate end 15 (best viewed in FIGS. 2 and 4). A lip 20 is illustrated attached to and extending from extension 19 at pivot 21 at a 135-degree angle for example. As shown, face 18 defines an ejector hole 23 which may be used to eject an insert or receive a peg on the back of an insert. In at least one embodiment, the clip 10 may be made of any durable material such as plastic, metal and the like. It is understood that the clip 10 may be made entirely of one material, or different parts of the clip 10 may be made of different materials.

Figure 2:
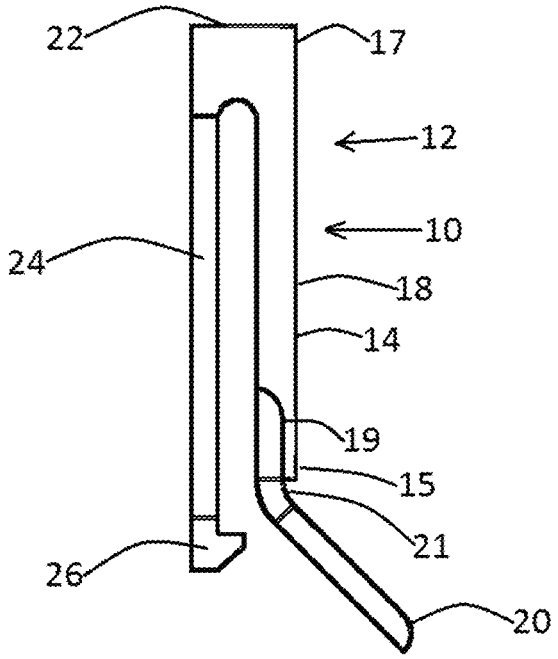
FIG. 2 depicts a left side elevational view of the holder of FIG. 1.

FIGS. 2 and 4 depict opposing side views of the clip 10 illustrating the lip 20 coupled to extension 19 at pivot 21. As shown, extension 19 is on the same plane as body 12 while lip 20 is shown at a predetermined angle to extension 19. FIGS. 2 and 4 further illustrate a connecting portion 22 extending from body 12 proximate second end 17. As illustrated, the connecting portion or connector 22 extends in a general direction different from both body 12 and lip 20. A member 24 depends from connecting portion 22 in a direction generally parallel to the face 18 and body 12. As illustrated, the member 24 includes a catch 26.

Figure 3:
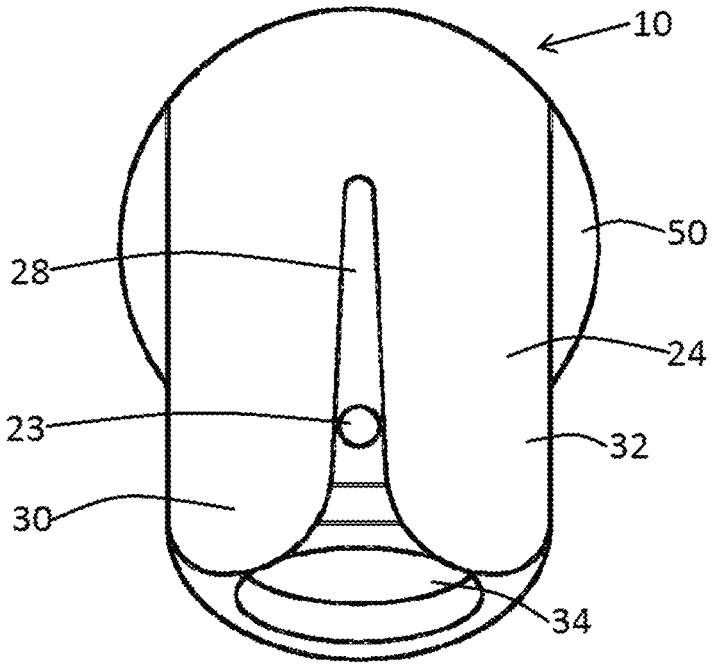
FIG. 3 depicts a rear elevational view of the holder of FIG. 1.

FIG. 3 depicts a rear elevation view of the clip 10 illustrating one embodiment of the member 24. As illustrated, member 24 defines a slot 28 (a button catching slot for example) such that depending portion 24 forms a generally u-shaped member having fingers 30 and 32, wherein each finger includes a hook.

Figure 6:
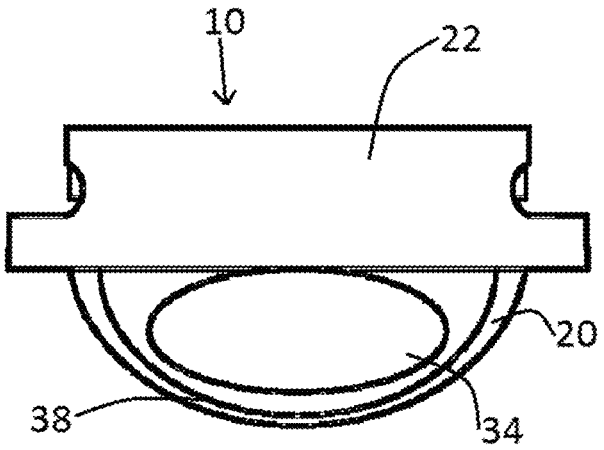
FIG. 6 depicts a top plan view of the holder of FIG. 1.
Figure 7:
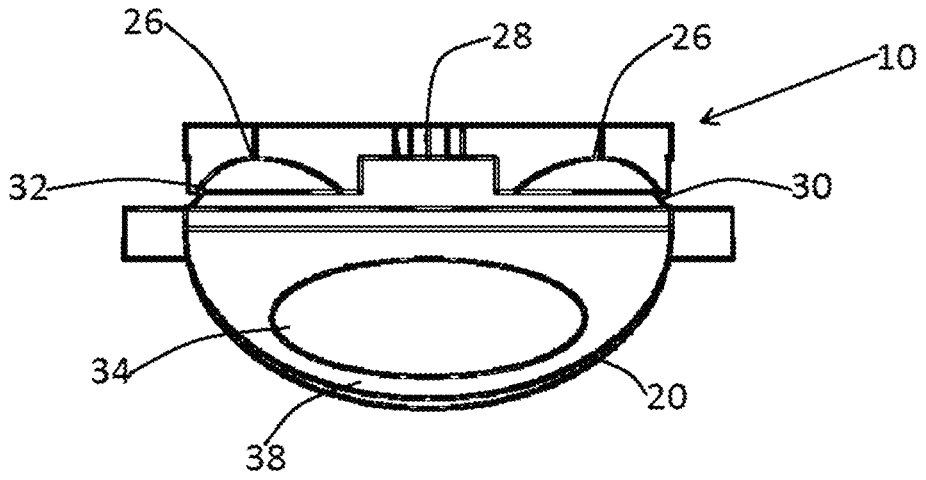
FIG. 7 depicts a bottom plan view of the holder of FIG. 1.

FIG. 6 depicts a top plan view of clip 10. As illustrated, lip 20 includes curved or ring portion 38 defining opening or holder portion 34 which is adapted to receive one or more personal effects. FIG. 7 depicts a bottom plan view of the clip 10, illustrating lip 20 defining opening 34.

Figure 8:
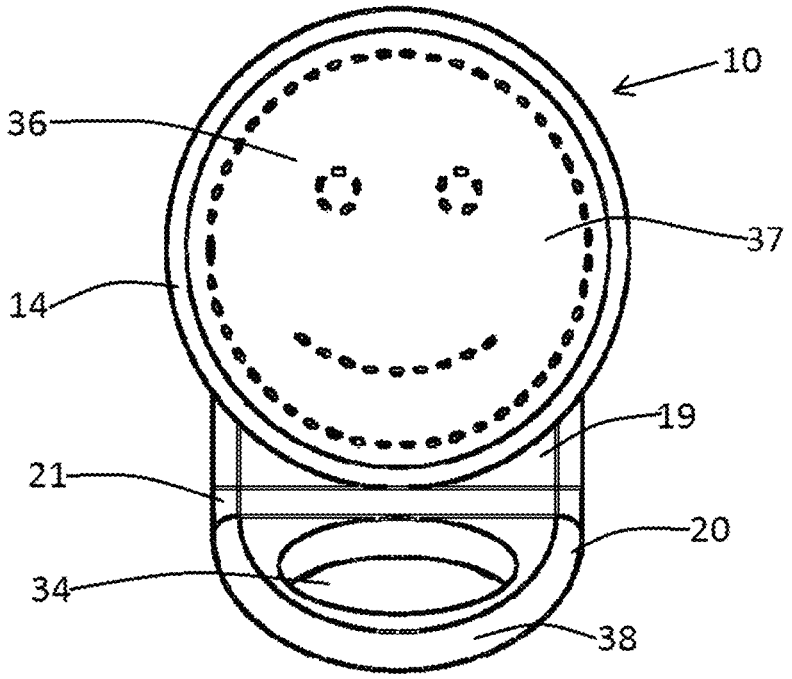
FIG. 8 depicts a front elevational view of the holder of FIG. 1 including an insert.

FIG. 8 illustrates another embodiment of the clip 10. In this embodiment, face 18 is adapted to receive insert 36 which may abut against at least a portion of the edge 14 or may engage hole 23 or eyebrow hole 39 (See FIG. 9). In one embodiment, the clip 10 includes an indicia 37. The indicia may be printed directly on the face 18 or the insert 36. In one or more embodiments, the insert 36 may be printed with any type of ink or image, including images that are luminescent, textured, 3D printed and the like. The insert may include art, picture, graphic images or could include a device such as a panic button, camera, microphone, camera, GPS locator, display screen, flashing light and the like.

Figure 9:
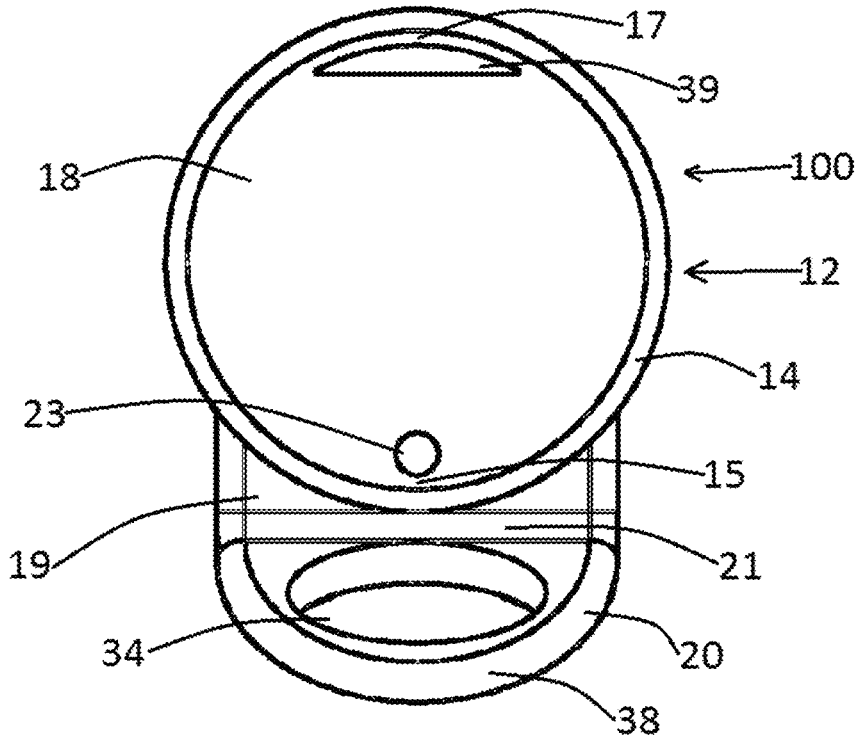
FIG. 9 depicts a front elevational view of another embodiment of a personal effects holder.
Figure 10:
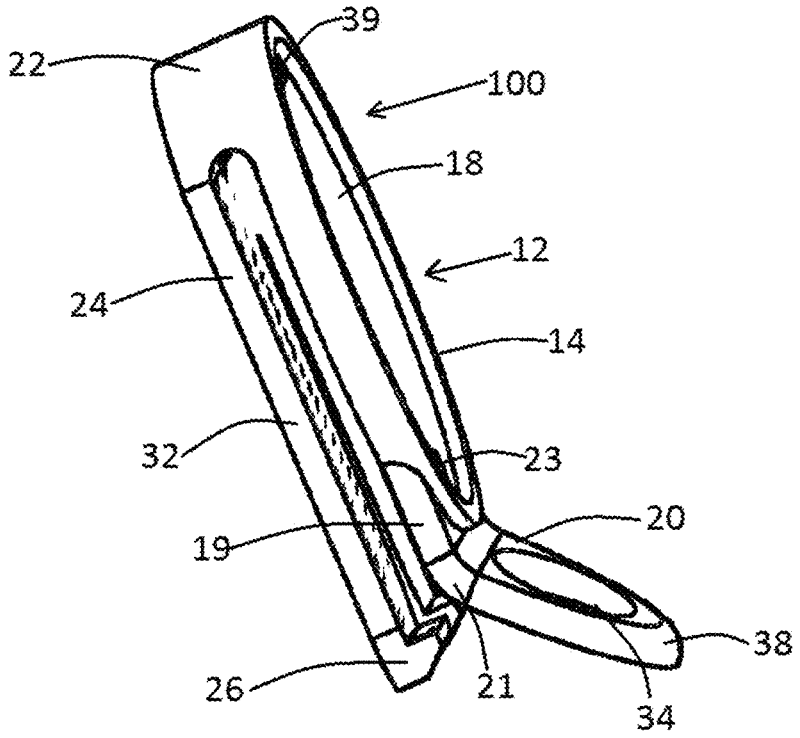
FIG. 10 depicts a perspective view of the holder of FIG. 9.

FIGS. 9 and 10 illustrates a clip 100 similar to that discussed above with respect to FIGS. 1-8. FIG. 9 depicts a front elevation view of clip 100 while FIG. 10 depicts a perspective view thereof. As shown, FIG. 9 depicts face 18 defining eyebrow opening 39.

Figure 11:
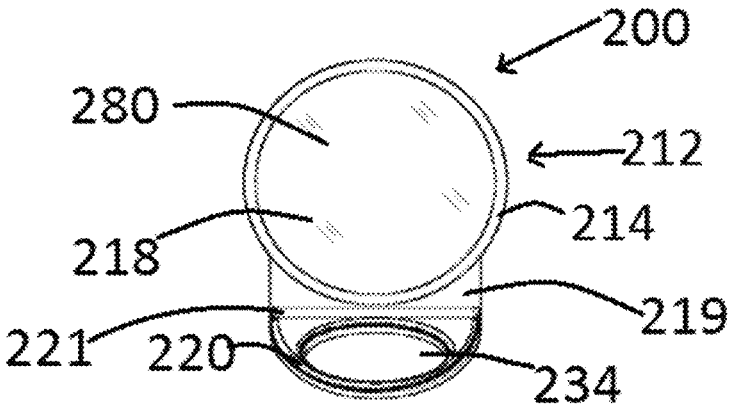
FIG. 11 depicts a front elevational view of yet another embodiment of a s personal effects holder similar to FIG. 8.

FIG. 11 illustrates an elevational view of yet another personal effects holder or clip, generally designated 200, including edge 214 defining face 218. In this embodiment, clip 200 includes an extension 219 extending from body 212 and coupled to pivot 221. In at least one embodiment, the clip 200 may be made of any durable material such as plastic, metal and the like. It is understood that the clip 200 may be made entirely of one material, or different parts of the clip 200 may be made of different materials. It is contemplated that insert 280 may be in removable or non-removable engagement with at least end 214 and/or face 218. It is contemplated that insert 280 is a clear cover which includes a separate indicia which fits within or it includes a cover with the indicia printed thereon or incorporated therein.

Figure 12:
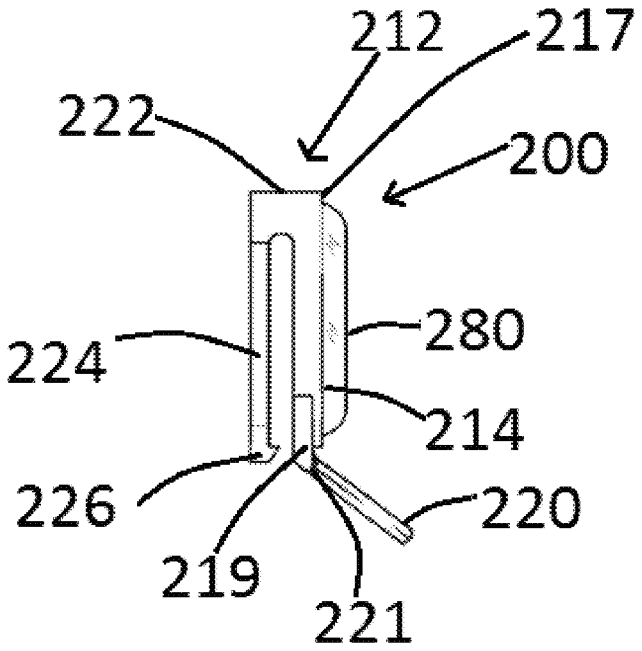
FIG. 12 depicts left side elevation view of the personal effects holder of FIG. 11.
Figure 13:
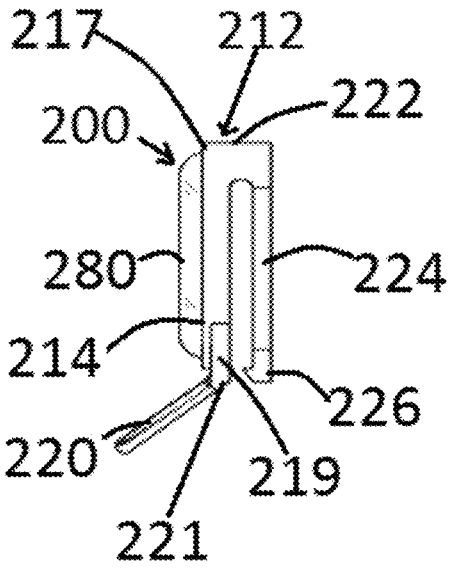
FIG. 13 depicts a right-side elevational view of the personal effects holder of FIG. 11.

FIGS. 12 and 13 depict opposing side views of the clip 200 illustrating the lip 220 extending from the extension 219 at pivot 221. FIGS. 12 and 13 further illustrate a connecting portion 222 extending from body 212 proximate end 217 opposite the edge 214 having lip 220 attached thereto. As illustrated, the connecting portion or connector 222 extends in a generally different direction to the lip 220. A member 224 depends from connecting portion 222 in a direction generally parallel to the face 218. As illustrated, the member 224 includes a catch 226.

Figure 14:
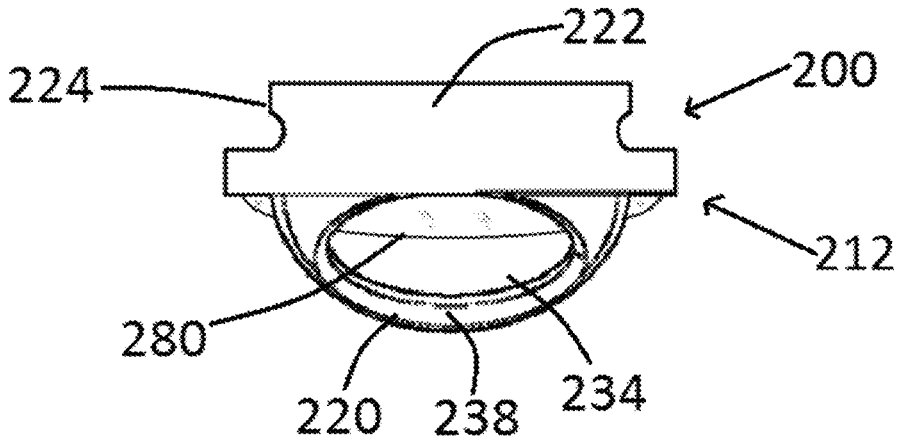
FIG. 14 depicts a top plan view of the personal effects holder of FIG. 11.
Figure 15:
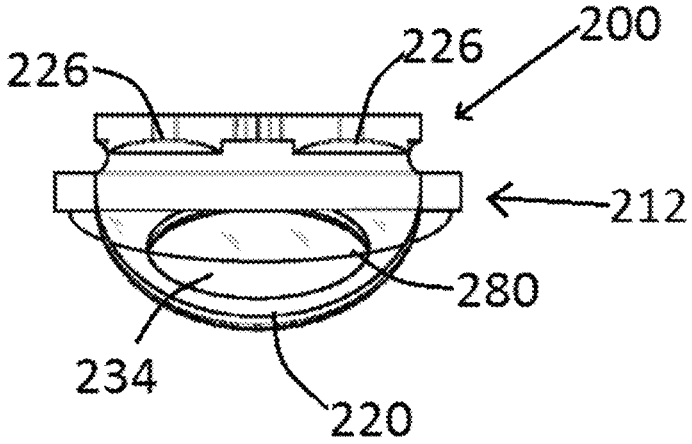
FIG. 15 depicts a bottom plan view of the personal effects holder of FIG. 11.

FIG. 14 depicts a top plan view of clip 200. As illustrated, lip 220 includes a curved portion 238 defining opening or holder portion 234 which is adapted to receive one or more personal effects. FIG. 15 depicts a bottom plan view of the clip 200 illustrating a bottom view of lip 220 defining opening 234.

Figure 16:
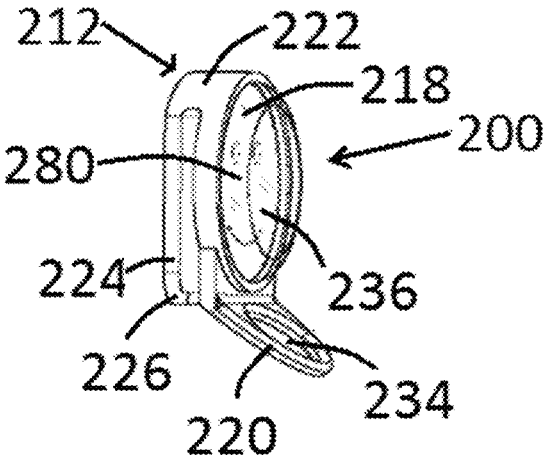
FIG. 16 depicts a first perspective view of the personal effects holder of FIG. 11.

FIG. 16 illustrates a perspective view of the clip 200 having insert 280. Again, it is contemplated that insert 280 may include a clear cover which includes a separate indicia which fits within or it includes a cover with the indicia printed thereon or incorporated therein. In this embodiment, face 218 has indicia printed or written thereon or is adapted to receive an insert 236 which may abut against at least a portion of edge 214. In one embodiment, the insert 236 includes an indicia. The indicia may be printed directly on the insert 236 or a separate piece affixed to the face of insert 236 or to the back of a transparent cover. In one or more embodiments, the indicia may be printed with any type of ink or image, including images that are luminescent, textured, 3D printed and the like. Alternatively, the clip may have a light source which illuminates the indicia. The indicia may be made of a rewriteable material, such as a chalkboard or white board like material, allowing the user to create their own indicia.

It should be appreciated that the insert can be permanently secured to the face using glue for example. However, embodiments are contemplated in which the insert is removably and replaceably secured to the clip 200, using a friction fit, interference fit, tongue and grove, peg and hole, and the like.

The openings are shown as oval. While oval is preferred, any shape is contemplated including round, square, rectangular, multi-sided, foot ball shaped, and the like, as long as it is able to receive the temple of a pair of eye-glasses or ear-buds of earphones for example.

Figure 17:
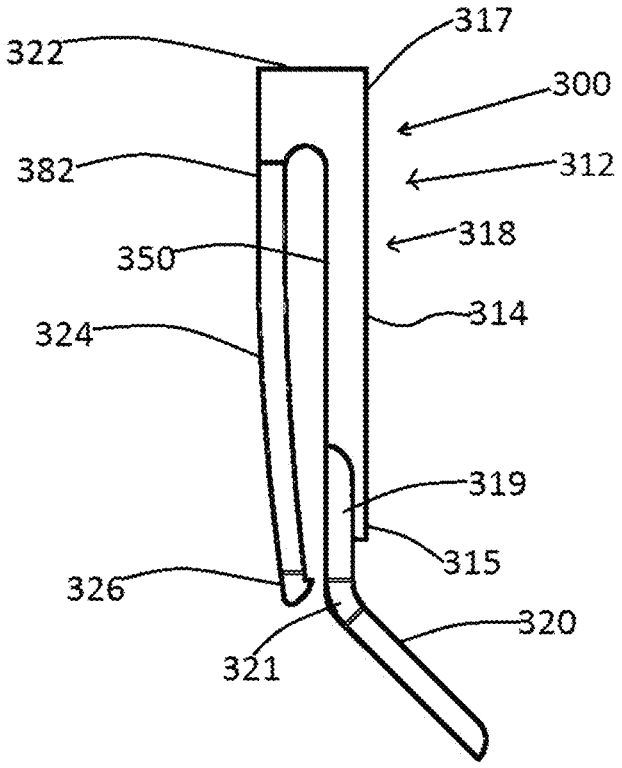
FIG. 17 depicts a left side view of another embodiment of a personal effects holder.
Figure 18:
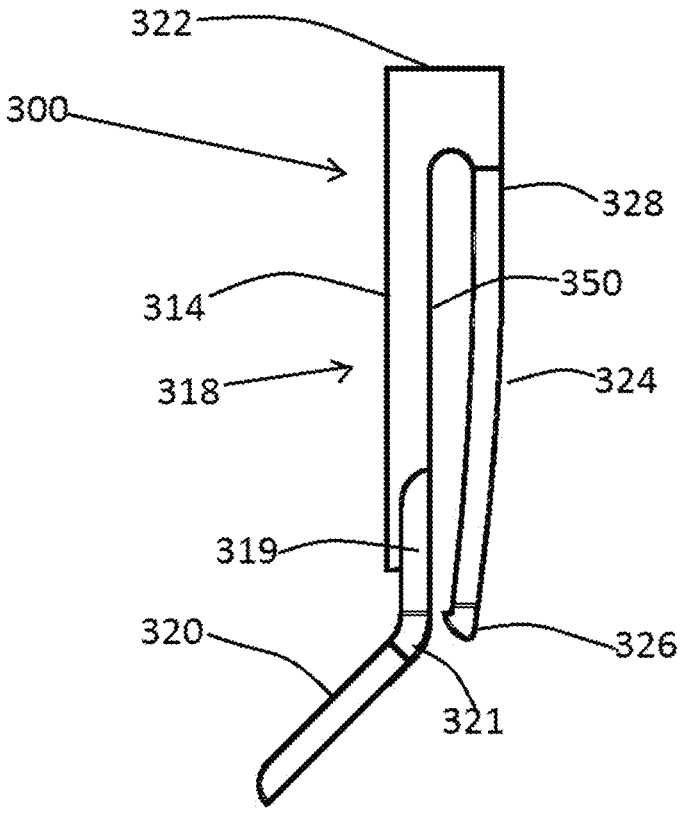
FIG. 18 depicts a right side of the personal effects holder of FIG. 17.

FIGS. 17 and 18 illustrates opposing side views of a clip, generally designated 300, having first end 315 and second end 317. FIGS. 17 and 18 depict clip 300 having extension 319 at first end 315. Lip 320 is coupled to and extends from extension 319 at pivot 321. The figures further illustrate a connecting portion 322 extending from body at end 317 opposite the end 315. As illustrated, the connecting portion 322 extends in a direction generally opposite that of the lip 320. A member 324 depends from connecting portion 322, portion 324 having end 382 and catch 326. As illustrated, member 324 extends the same direction as face 318. However, member 324 bends or is inclined toward a back face 350 of face 318, such that end 382 is spaced farther from back face 350 than catch 326.

Figure 19:
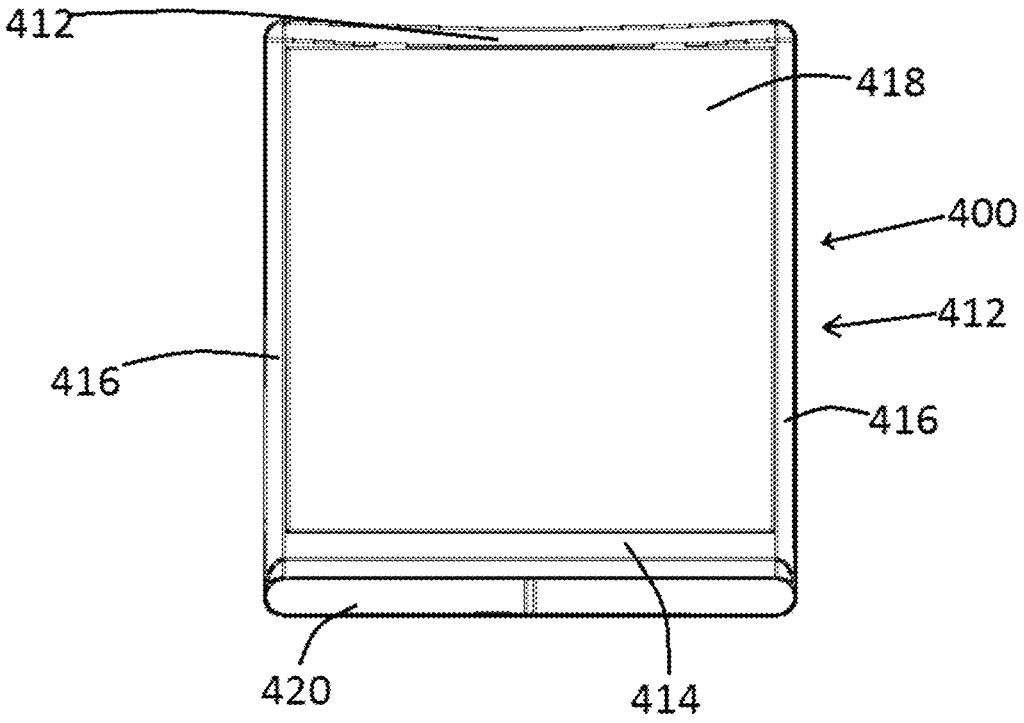
FIG. 19 depicts a front elevational view of still another embodiment of a personal effects holder.
Figure 23:
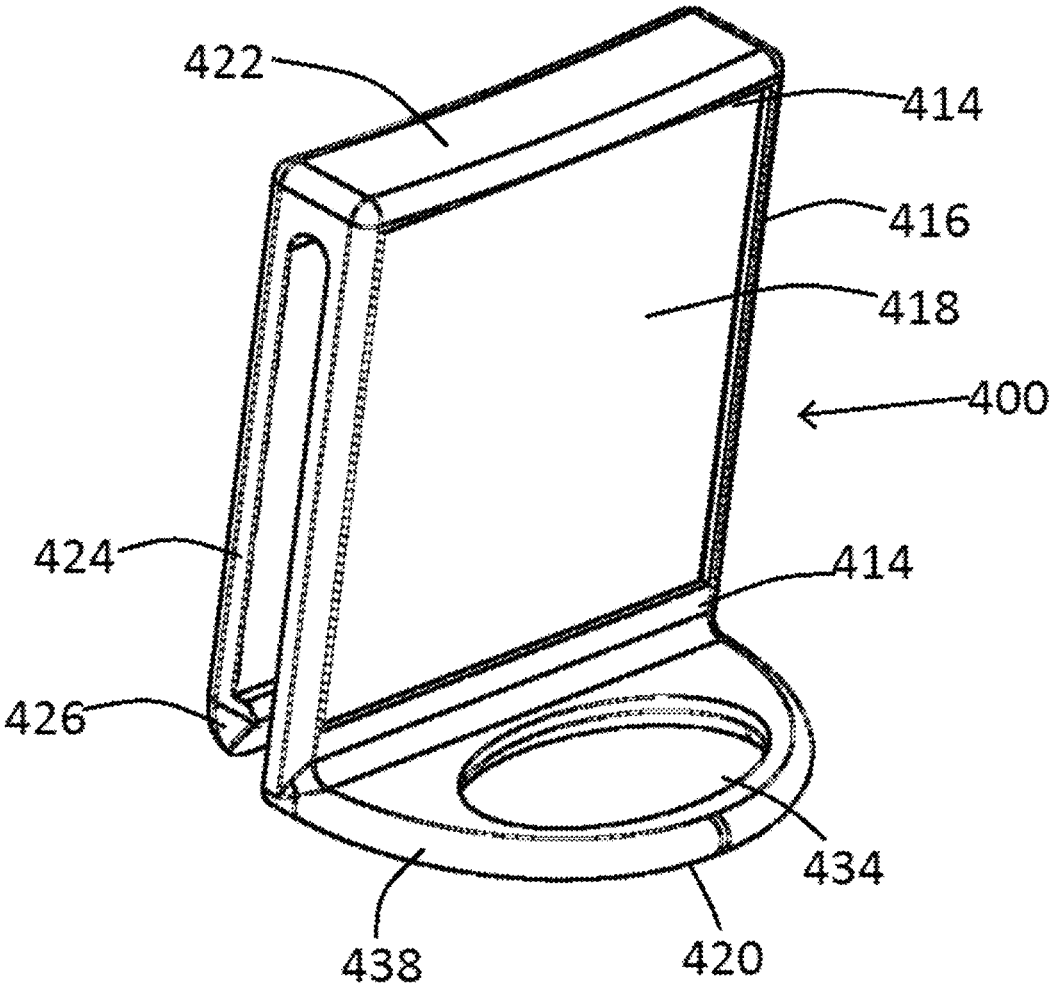
FIG. 23 depicts a perspective view of the personal effects holder of FIG. 19.

FIGS. 19 and 23 illustrate elevational and perspective views of still another embodiment of the personal effects holder or clip, generally designated 400, and including opposing ends 414 and opposing ends 416 defining face or fascia 418. In at least one embodiment, clip 400 includes a lip 420 attached to and extending from the clip proximate one of the opposing edges 414. The clip 400 may be made of any durable material such as plastic, metal and the like. It is understood that the clip 400 may be made entirely of one material, or different parts of the clip 400 may be made of different materials.

Figure 20:
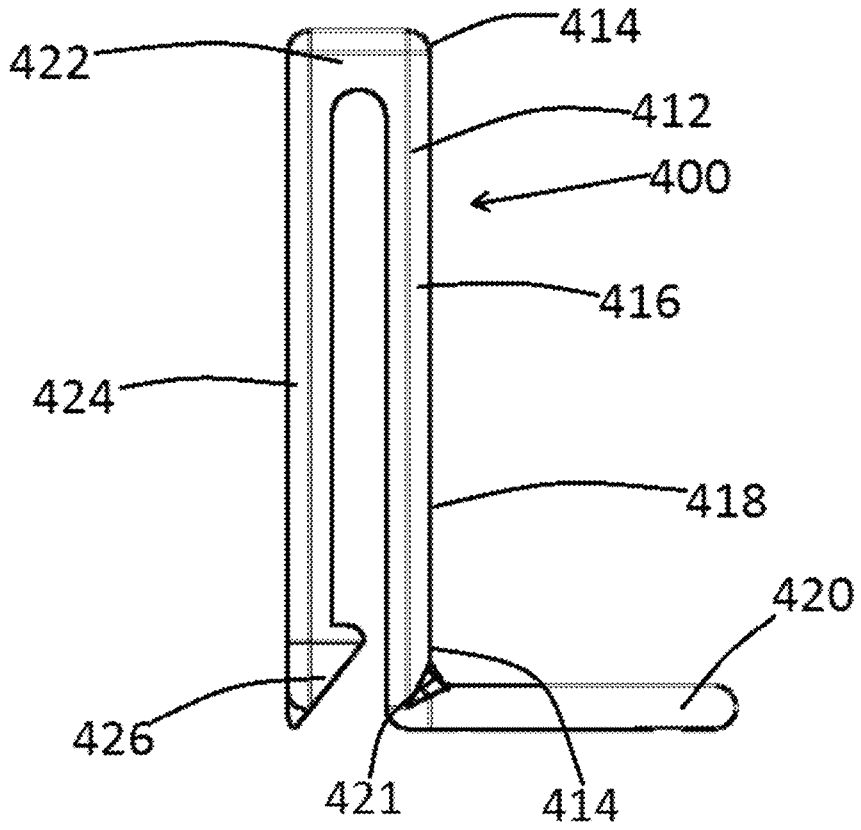
FIG. 20 depicts a left side elevational view of the personal effects holder of FIG. 19.
Figure 22:
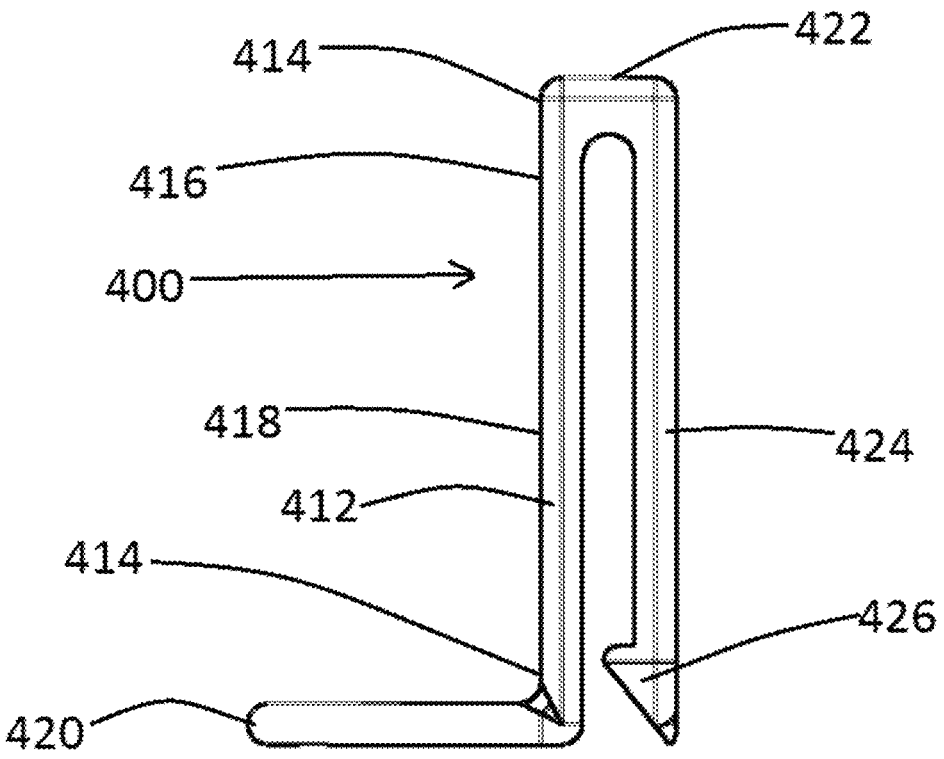
FIG. 22 depicts a right-side elevation view of the personal effects holder of FIG. 19.

FIGS. 20 and 22 depict opposing side views of the clip 400 illustrating the lip 420 extending from the clip 400 at pivot 421 proximate one of the opposing ends 414. FIGS. 20 and 22 further illustrate a connecting portion 422 extending from another opposing edge 414 opposite the opposing edge 414 having lip 420 attached to pivot 421. As illustrated, the connecting portion 422 extends generally in a direction opposite that of the lip 420. A member 424 depends from connecting portion 422 in a direction generally parallel to the face 418. As illustrated, the member 424 includes a catch 426.

Figure 21:
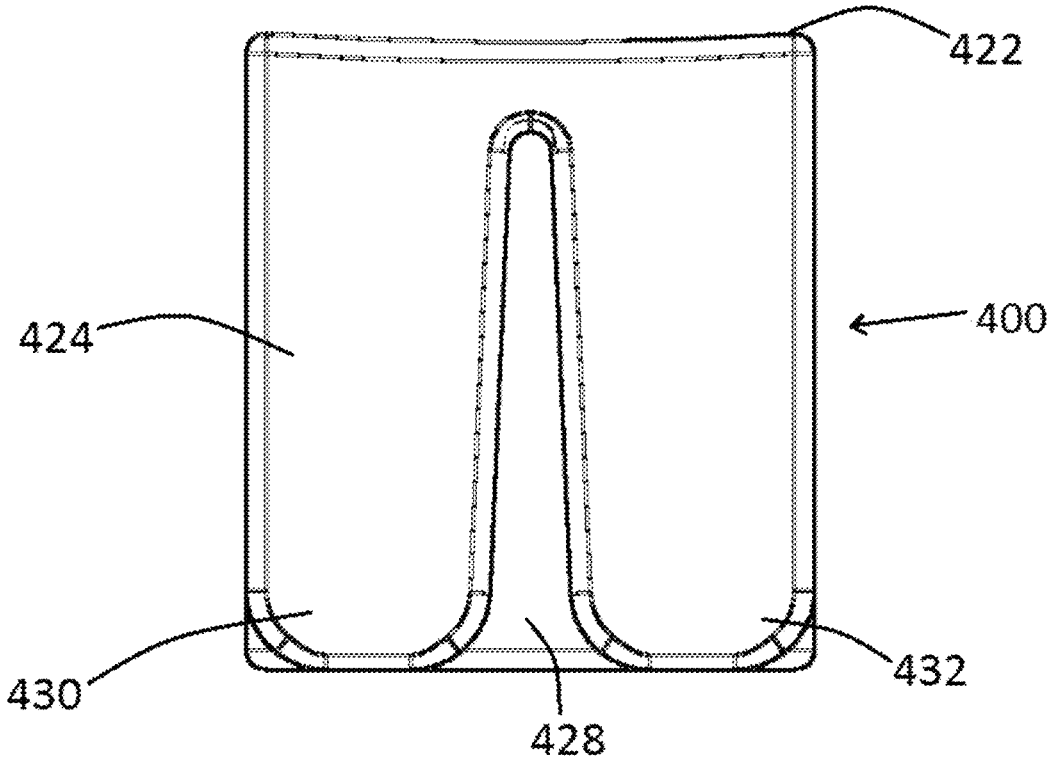
FIG. 21 depicts a rear elevational view of the personal effects holder of FIG. 19.

FIG. 21 depicts a rear elevation view of the clip 400 illustrating one embodiment of the depending portion 424. As illustrated, depending portion 424 defines a slot 428 such that depending member 424 forms a generally u-shaped member having fingers 430 and 432.

Figure 24:
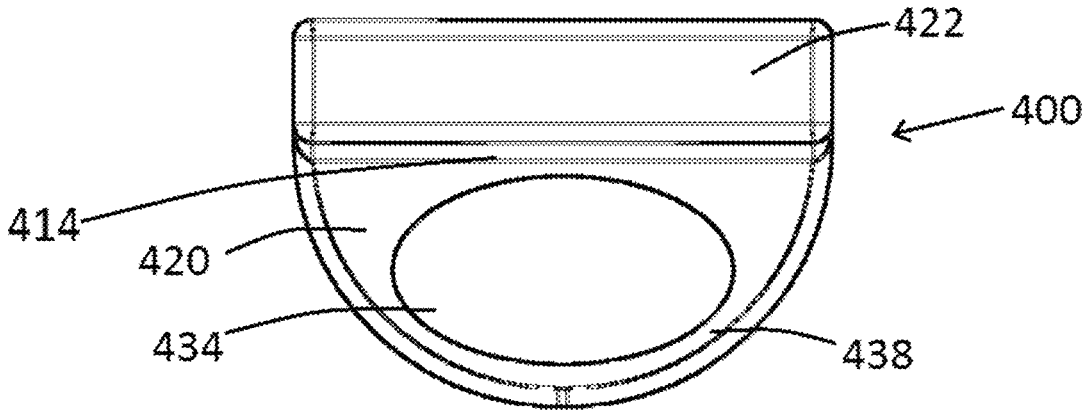
FIG. 24 depicts a top plan view of the personal effects holder of FIG. 19.
Figure 25:
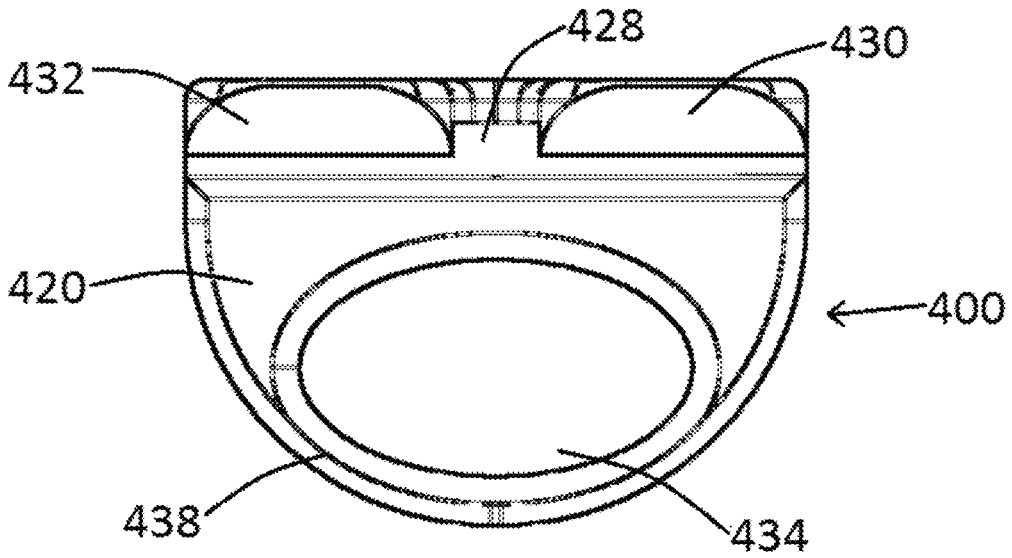
FIG. 25 depicts a bottom plan view of the personal effects holder of FIG. 19.

FIG. 24 depicts a top plan view of clip 400. As illustrated, lip 420 includes curved or ring portion 438 defining opening or holder portion 434 which is adapted to receive one or more personal effects. FIG. 25 depicts a bottom plan view of the clip 400, illustrating lip 420 defining opening 434.

Figure 26:
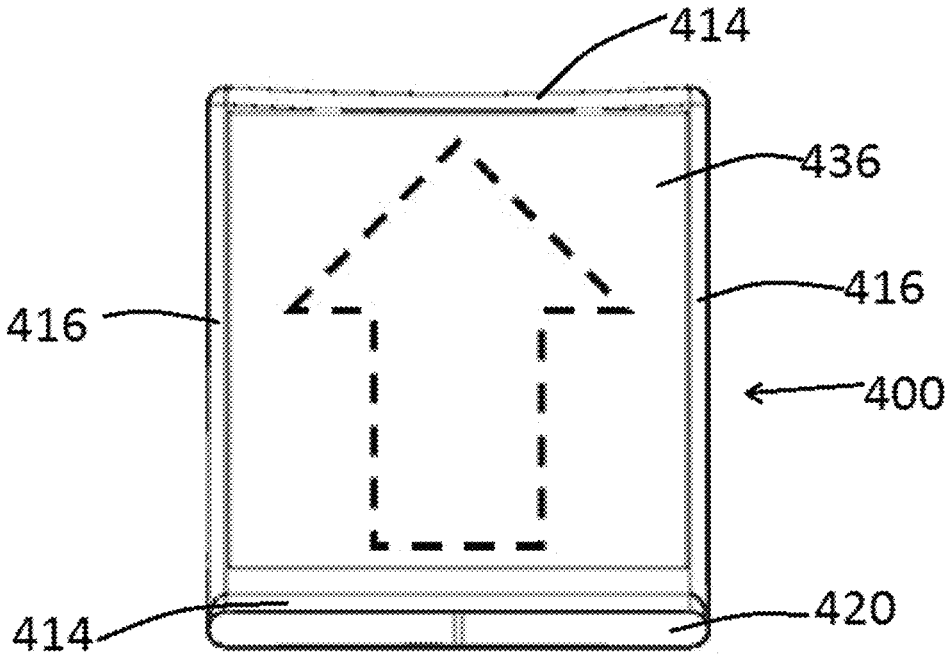
FIG. 26 depicts a perspective view of the personal effects holder of FIG. 19 including an insert.

FIG. 26 illustrates another embodiment of the clip 400. In this embodiment, face 418 is adapted to receive insert 436 which may abut against one or more of the edges. In one embodiment, the clip 400 includes an indicia. The indicia may be printed directly on the face 418 or a separate piece affixed to the face 418. In one or more embodiments, the indicia on the insert 436 may be printed with any type of ink or image, including images that are luminescent, textured, 3D printed and the like, and may include a transparent cover.

Figure 27:
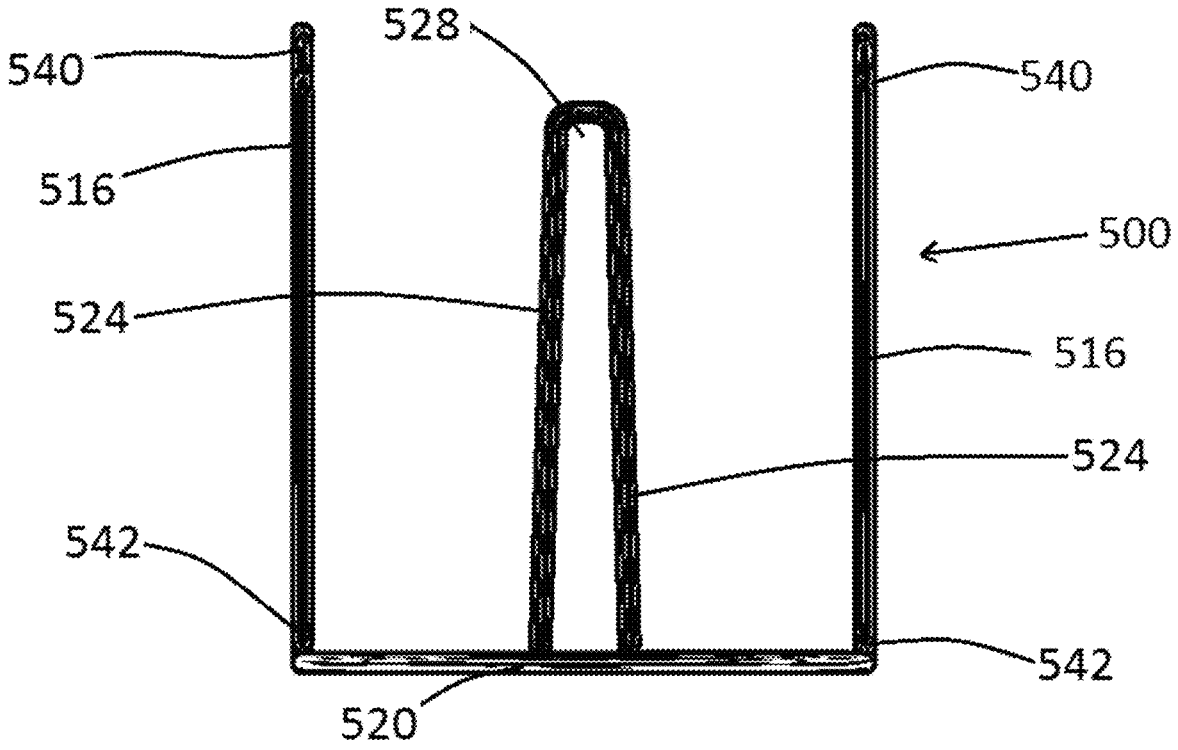
FIG. 27 depicts a front elevational view of a clip used in another embodiment of a personal effects holder which may be inserted into or contained by a cap.

FIG. 27 illustrates another embodiment of the personal effects holder or clip, designated 500. In at least one embodiment, clip 500 is adapted to receive a cap 600 (See FIG. 34 for example). Clip 500 includes first or front opposing wires 516 each having upper portion 540 and lower portion 542. In at least one embodiment, clip 500 includes a lip 520 attached to and extending therefrom proximate one of the opposing edges lower portion 542 and includes curved portion 538 defining opening 534 (See FIGS. 27 and 31-33 for example). In one or more embodiments, the clip 500 may be formed of plated metal or spring steel or any other suitable material that allows it to be bent or manufactured into the desired shape.

FIG. 27 further illustrates opposing wires 524, having upper portion 525 and lower portion 527 (best viewed in FIGS. 28 and 30) on a plane parallel to a plane defined by wires 516.

Figure 28:
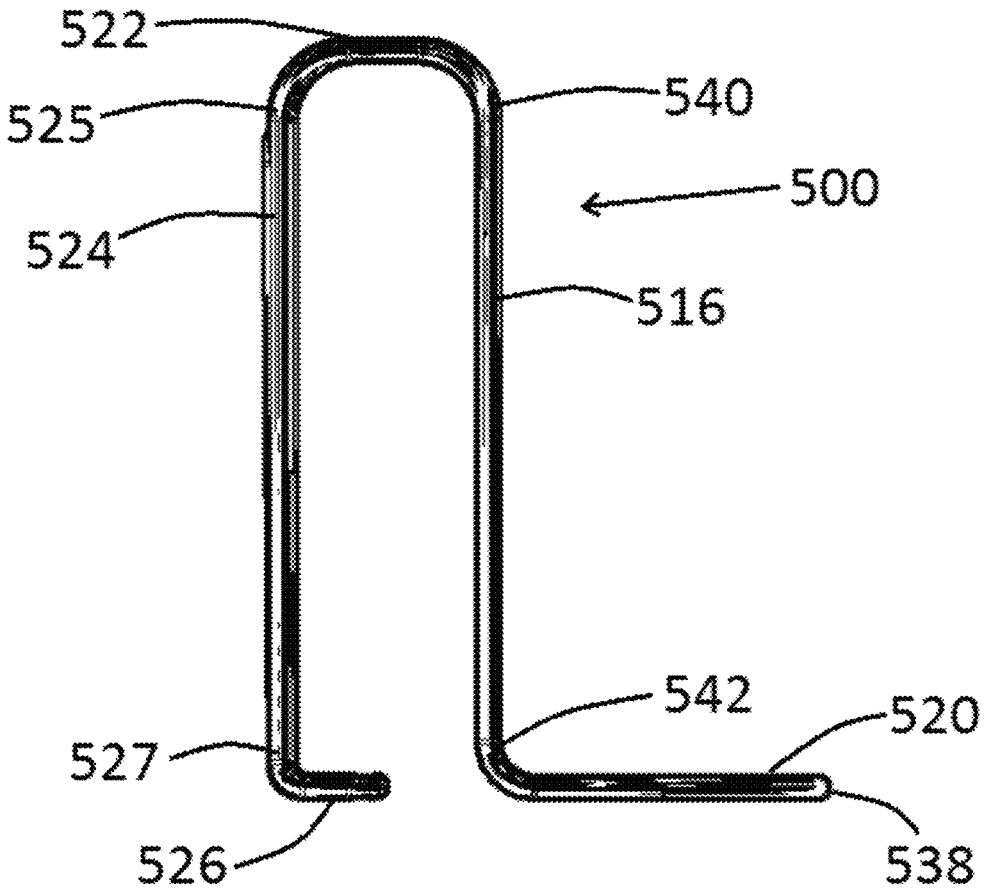
FIG. 28 depicts a left side elevational view of the clip of FIG. 27.
Figure 30:
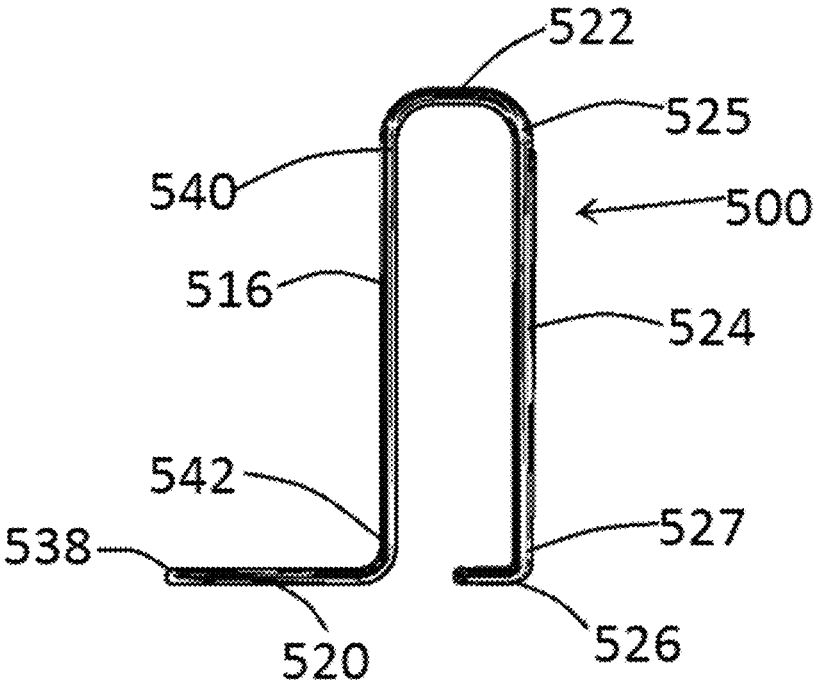
FIG. 30 depicts a right-side elevation view of the clip of FIG. 27.

FIGS. 28 and 30 depict left and right-side elevational views of the clip 500 of FIG. 27. In the illustrated embodiment, clip 500 is shown having a catch 526 connected to and extending from wire 524 at lower portion 527 in a same plane as that defined by lip 520 and curved edge 538. As illustrated wires 516 and 524 are joined via connector 522 at upper portion 525 and 540 respectively.

Figure 29:
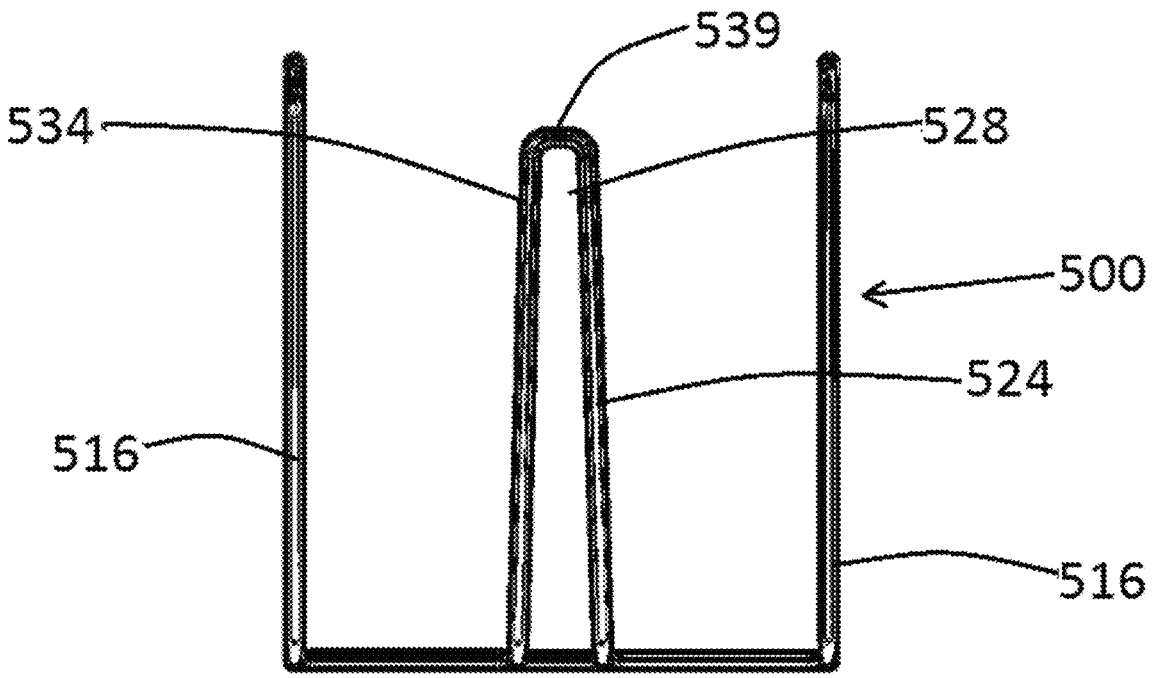
FIG. 29 depicts a rear elevational view of the clip of FIG. 27.

FIG. 29 depicts a rear elevational view of the clip 500 of FIG. 27 where FIG. 29 depicts wires 524 defining slot 528.

Figure 31:
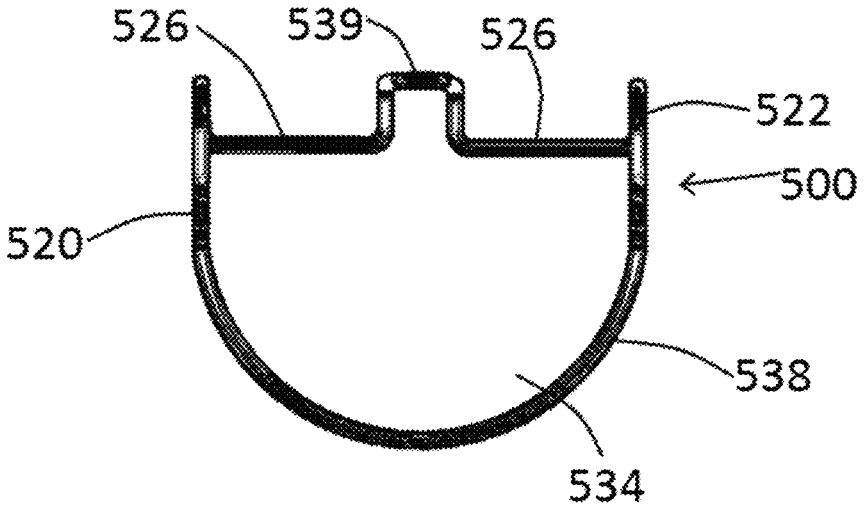
FIG. 31 depicts a top plan view of the clip of FIG. 27.
Figure 32:
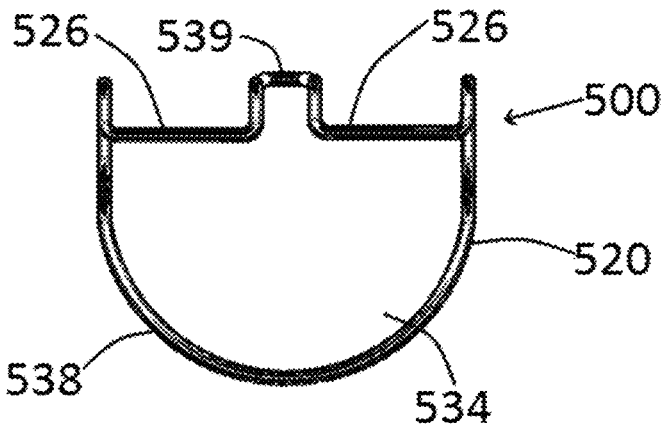
FIG. 32 depicts a bottom plan view of the clip of FIG. 27.

FIGS. 31 and 32 depict top and bottom plan views of the clip 500 of FIG. 27. FIGS. 31 and 32 illustrate lip 520 and curved portion 538 defining an opening, hole or holder portion 534.

Figure 33:
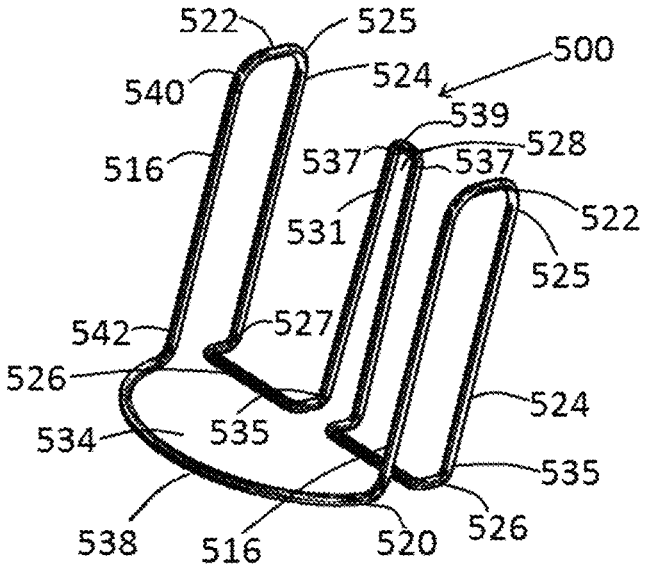
FIG. 33 depicts a perspective view of the clip of FIG. 27.

FIG. 33 depicts a perspective view of the clip 500 of FIG. 27 illustrating wires 531 having upper portion 537 and lower portion 535. Wires 531 are connected to each other via connector 539 at upper portion 537 and to catch 526 at lower portion 535 defining slot 528.

Figure 34:
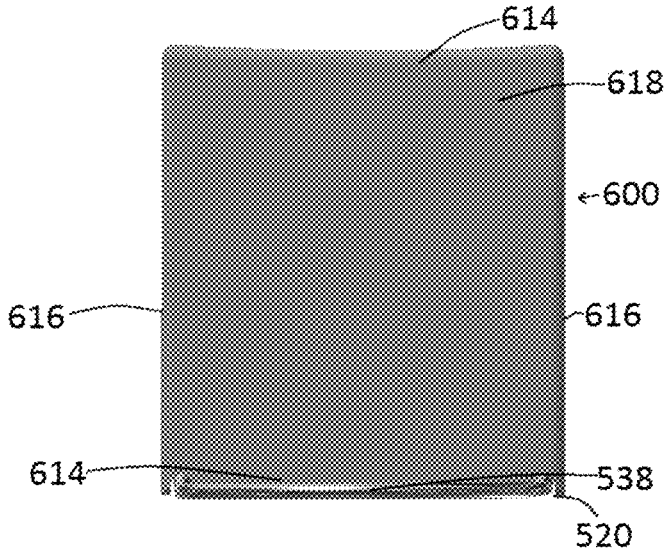
FIG. 34 depicts a front elevation view of one embodiment of a cap used with the clip of FIG. 27.

FIG. 34 illustrates a front elevation view of one embodiment of a cap, generally designated 600, used with the clip 500 of FIG. 27 for example. FIG. 34 illustrates that one embodiment of the cap 600 includes opposing edges 614 and opposing edge 616 defining face or fascia 618. In at least one embodiment, cap 600 communicates with clip 500 for example, such that lip 520 extends outwardly therefrom. In at least one embodiment, the cap 600 may removably engage clip 500 and may be made of any durable material such as plastic, metal and the like. It is understood that the cap 600 may be made entirely of one material, or different parts of the clip 600 may be made of different materials. In at least one embodiment, the clip 600 may be made of or covered in whole or in part by a luminescent or 3-D material.

While not shown, in one or more embodiments, face 618 is adapted to receive an insert having an indicia. The indicia may be printed directly on the face 618 or on an insert affixed to the face 618. In one or more embodiments, the indicia on the insert may be printed with any type of ink or image, including images that are luminescent, or 3D textured.

Figure 35:
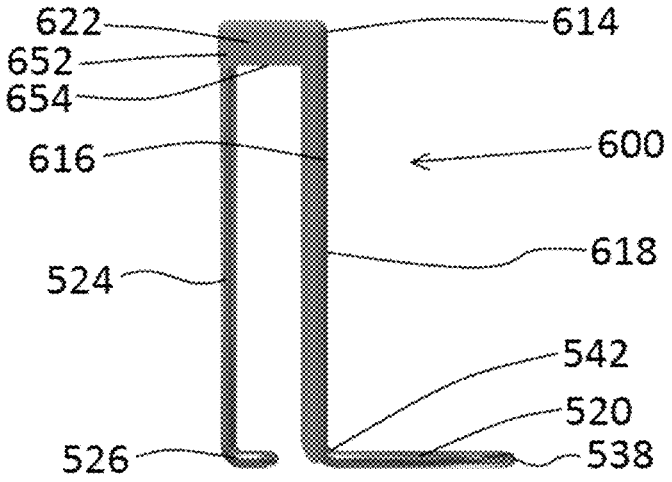
FIG. 35 depicts a left side of the cap of FIG. 34.
Figure 37:
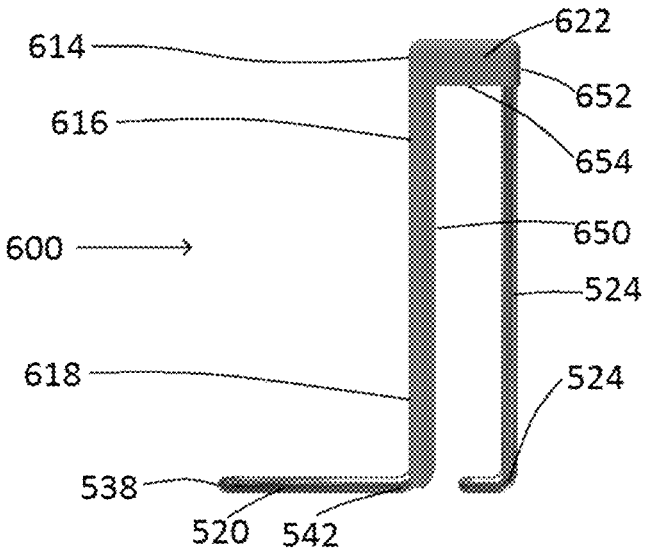
FIG. 37 depicts a right side of the cap of FIG. 34.

FIGS. 35 and 37 depict opposing side views of the cap 600 illustrating the lip 520 extending from the cap 600 proximate one of the opposing edges 614. FIGS. 35 and 37 further illustrate a connecting portion 622 extending from one opposing edge 614 opposite the opposing edge 614 which communicates with lip 520 attached thereto. As illustrated, the connecting portion 622 extends in a direction generally opposite that of the lip 520. A portion 652 depends or extends from connecting portion 622 in a direction generally parallel to the face 618. Portion 652, connecting portion 622 and back face 650 form receiving portion 654.

Figure 36:
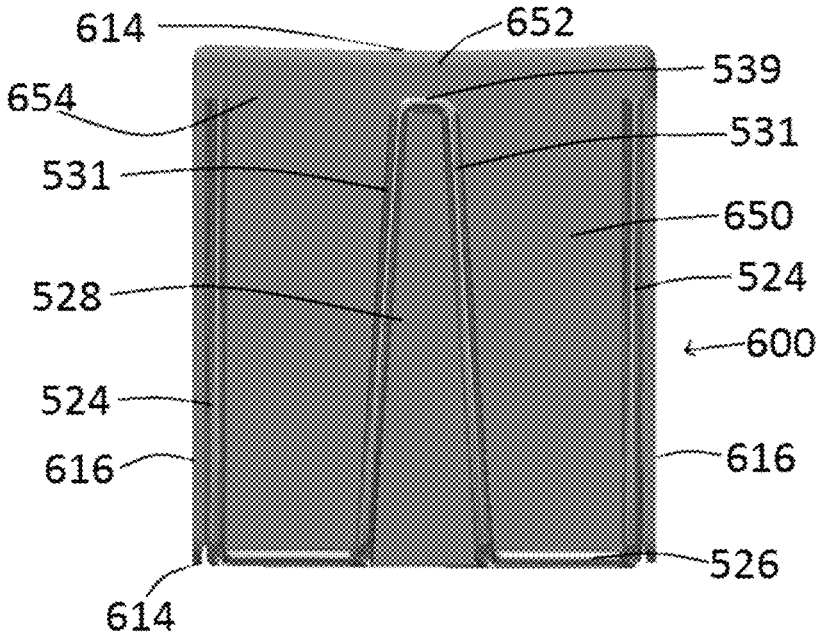
FIG. 36 depicts a rear view of the cap of FIG. 34.
Figure 38:
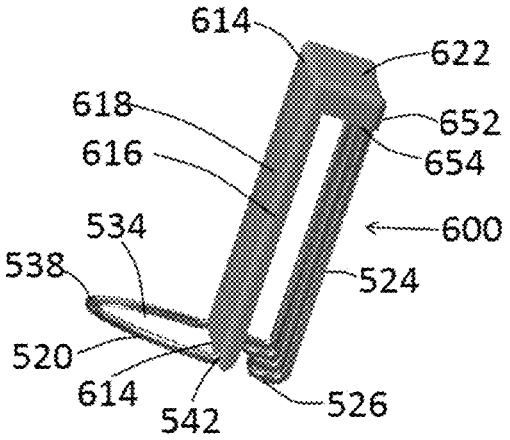
FIG. 38 depicts a perspective view of the cap of FIG. 34.
Figure 39:
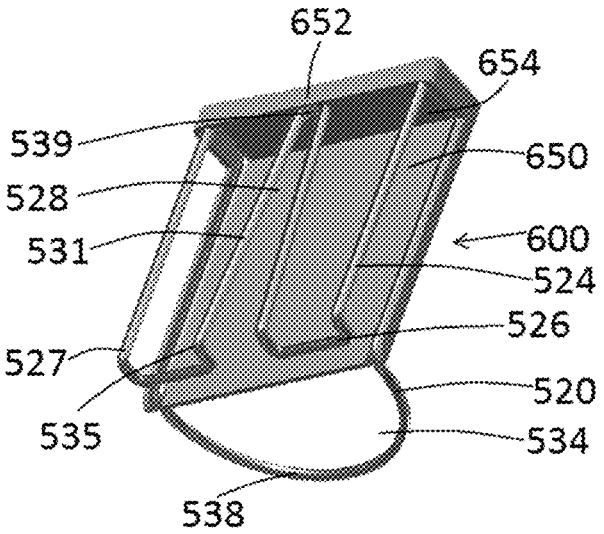
FIG. 39 depicts another perspective view of the cap of FIG. 34.

FIG. 36 depicts a rear elevational view of the cap 600 of FIG. 34, the arrangement of portion 652, connecting portion 622 and back face 650, forming receiving portion 654. FIG. 38 depicts an angled view of the right side of the cap 600 of FIG. 34, while FIG. 39 depicts an angled view of the rear of the cap 600 of FIG. 34.

Figure 40:
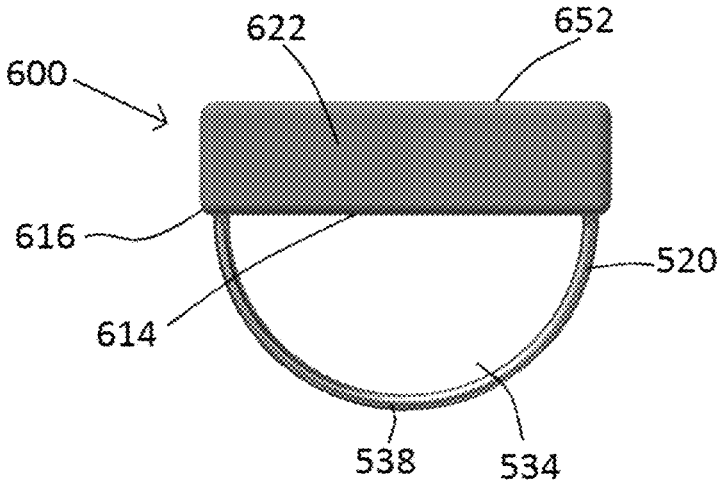
FIG. 40 depicts a top plan view of the cap of FIG. 34.
Figure 41:
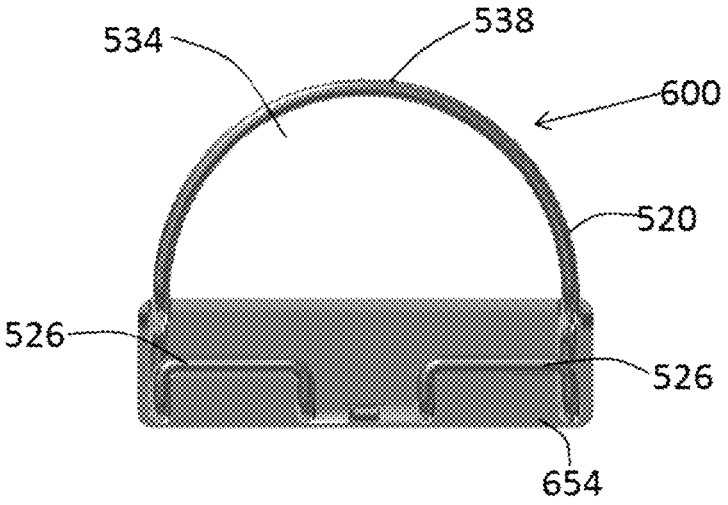
FIG. 41 depicts a bottom plan view of FIG. 34.
Figure 42:
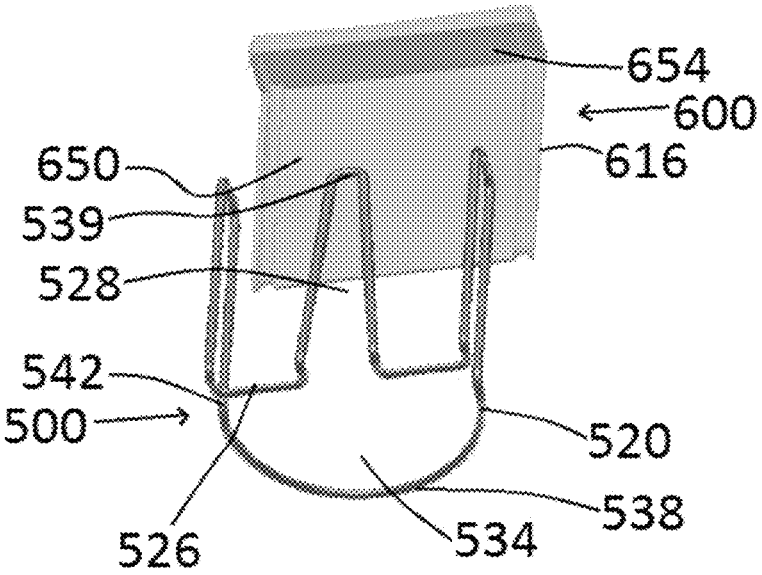
FIG. 42 depicts an exploded view of the cap of FIG. 34 and clip of FIG. 27.

FIG. 40 depicts a top plan view and FIG. 41 depicts a bottom plan view of the cap 600 of FIG. 34. FIG. 42 depicts an exploded view of the cap 600 of FIG. 34 and the clip 500 of FIG. 27.

Figure 43:
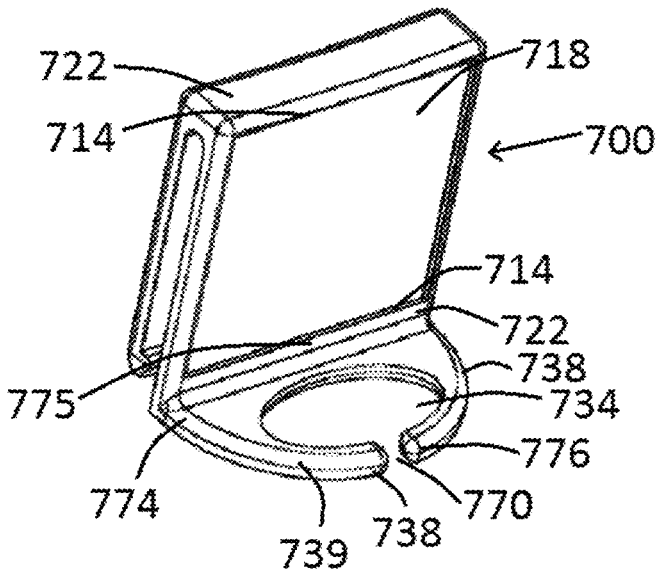
FIG. 43 depicts a perspective view of still another embodiment of a personal effects holder having flexible, deformable pincers.
Figure 44:
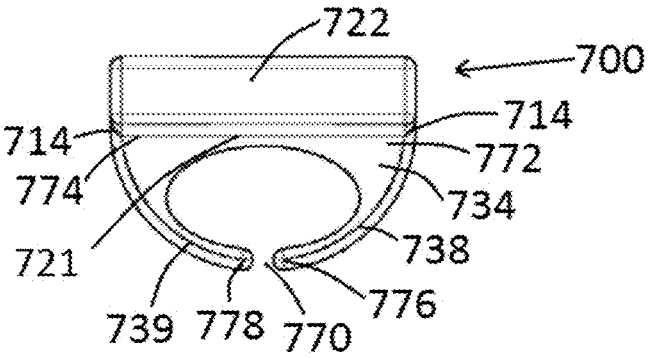
FIG. 44 depicts a top plan view of the personal effects holder of FIG. 43.

FIG. 43 illustrates a perspective view of still another embodiment of a personal effects holder, designated 700, having pincers. FIG. 44 depicts a top plan view of the personal effects holder 700 of FIG. 43. The curved portions previously illustrated are one solid, unbroken piece. However, it is contemplated that the curved portions in this embodiment comprise more than one solid piece forming deformable pincers or flexible pass through arrangement. More specifically, in the embodiment illustrated in FIGS. 43-44, the personal effects holder 700 includes two curved portions 738 and 739.

As illustrated, curved portions 738 and 739 have ends 772 and 774, defining hinge or pivot 775, respectively coupled to opposing edges 714. In one embodiment, curved portions 738 and 739 have opposing ends 776 and 778 respectively in proximity to each other, defining one or more slots 770, thereby forming the pincers or flexible pass through arrangement. These pincers or grasping arrangement allows the user's personal effects to be passed through the slot 770. It should be understood that, while the slot 770 is shown in the middle of the curved pieces, slot 770 may be positioned closer to either end 772 or 774.

In the illustrated embodiments, the curved portions 438, 538 and 738-739 are shown or formed at about a 90-degree angle to the body or face. However, it is contemplated that the curved portions may be formed at any predetermined angle, ranging from 5 degrees to about 175 degrees, to the body or face.

Figure 45:
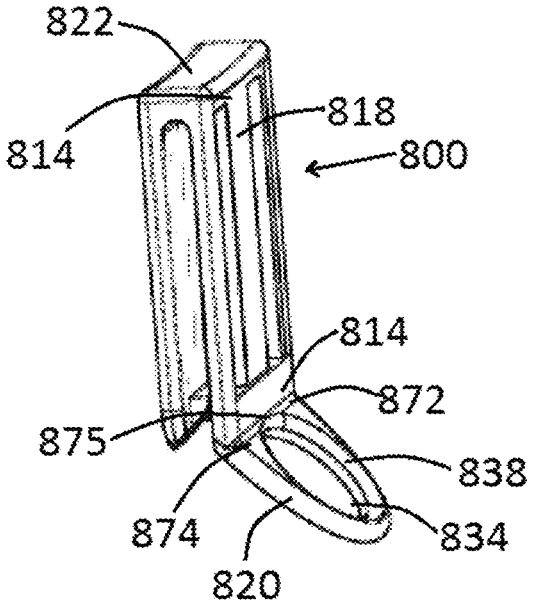
FIG. 45 depicts a perspective view of yet another embodiment of a personal effects holder having an angled curved portion.
Figure 46:
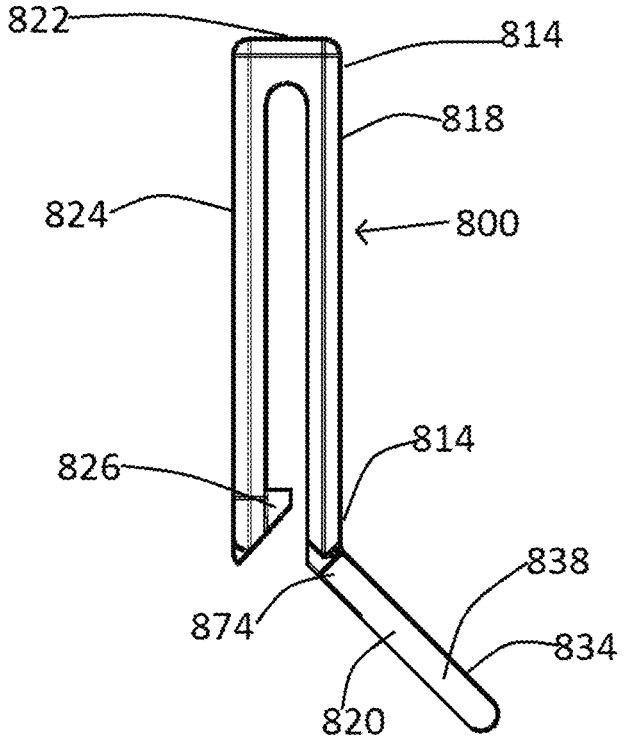
FIG. 46 depicts a side view of the personal effects holder of FIG. 45.
Figure 47:
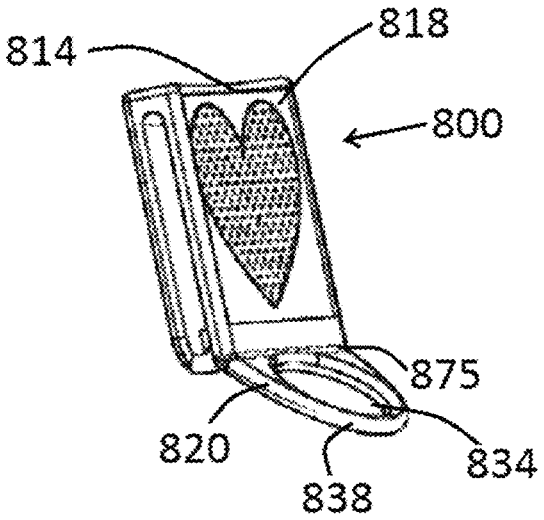
FIG. 47 depicts another perspective view of the personal effects holder of FIG. 45 including an indicia.

FIGS. 45-47 illustrate views of yet another embodiment of a personal effects holder having an angled curved portion. FIG. 45 illustrates a perspective view of the personal effects holder, designated 800, including a lip 820 attached to and extending from one of the opposing edges 814. In at least one embodiment, the clip 800 may be made of any durable material such as plastic, metal and the like. It is understood that the clip 800 may be made entirely of one material, or different parts of the clip 800 may be made of different materials. The lip 820 includes curved portion 838 which defines opening or holder portion 834 which is adapted to receive one or more personal effects previously illustrated as one solid, unbroken piece.

More specifically, in the embodiment illustrated in FIGS. 45-46, the personal effects holder 800 includes curved portion 838 having ends 872 and 874 respectively coupled to opposing edges 814 and defining hinge or pivot 875.

In the previous embodiments, the curved portions are shown or formed at about a 90-degree angle to the body or face. However, it is contemplated that the curved portions may be formed at any predetermined angle, ranging from 5 degrees to about 175 degrees. FIG. 46 depicts a side view of the personal effects holder 800 of FIG. 45 illustrating member 824 and catch 826. In this embodiment, the curved portion is defined at a 45-degree angle to a line defined by face or fascia 818 (or at a 135 degree to the body or face). FIG. 47 depicts another perspective view of the personal effects holder 800 of FIG. 45 having an indicia on face or fascia 818. In the illustrated embodiment, the curved portion is shown in a fixed position. However, it is contemplated that the curved portion is positionable and moveable about a pivot point and lockable in different positions.

Figure 48:
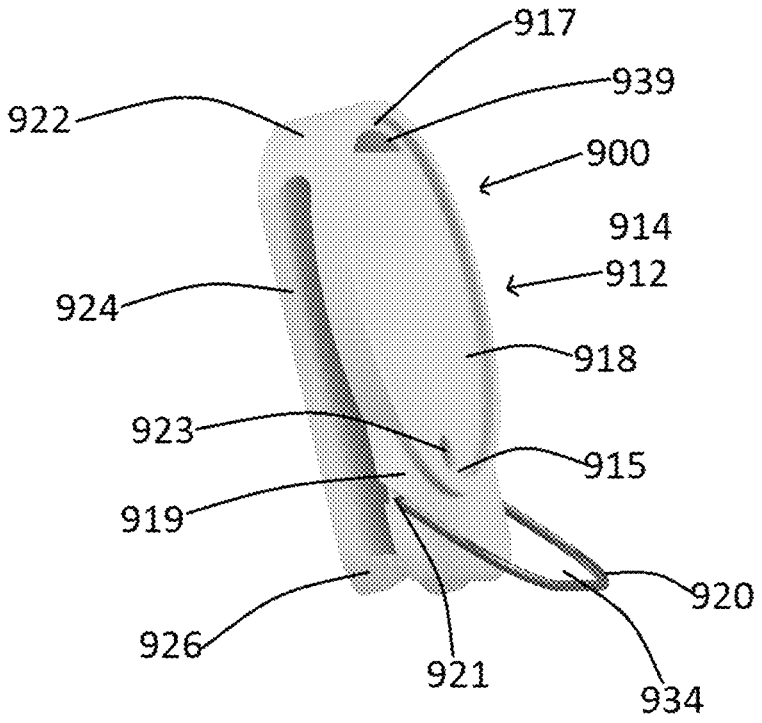
FIG. 48 depicts a perspective view of another embodiment of the personal effects holder with the lip in a functional position in accordance with one embodiment.
Figure 49:
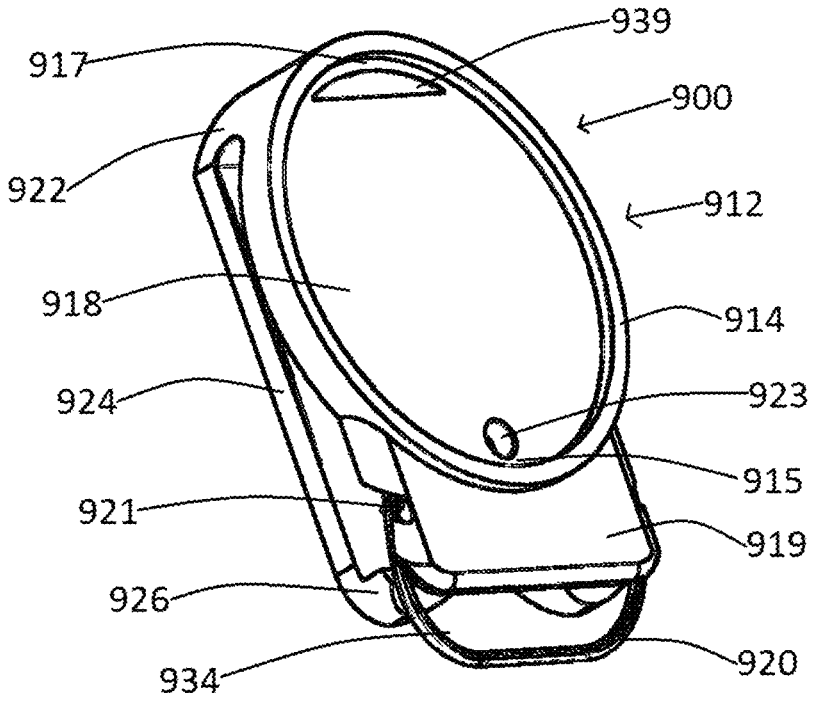
FIG. 49 depicts a perspective view of the personal effects holder of FIG. 48 with the lip in a stored position in accordance with one embodiment.
Figure 50:
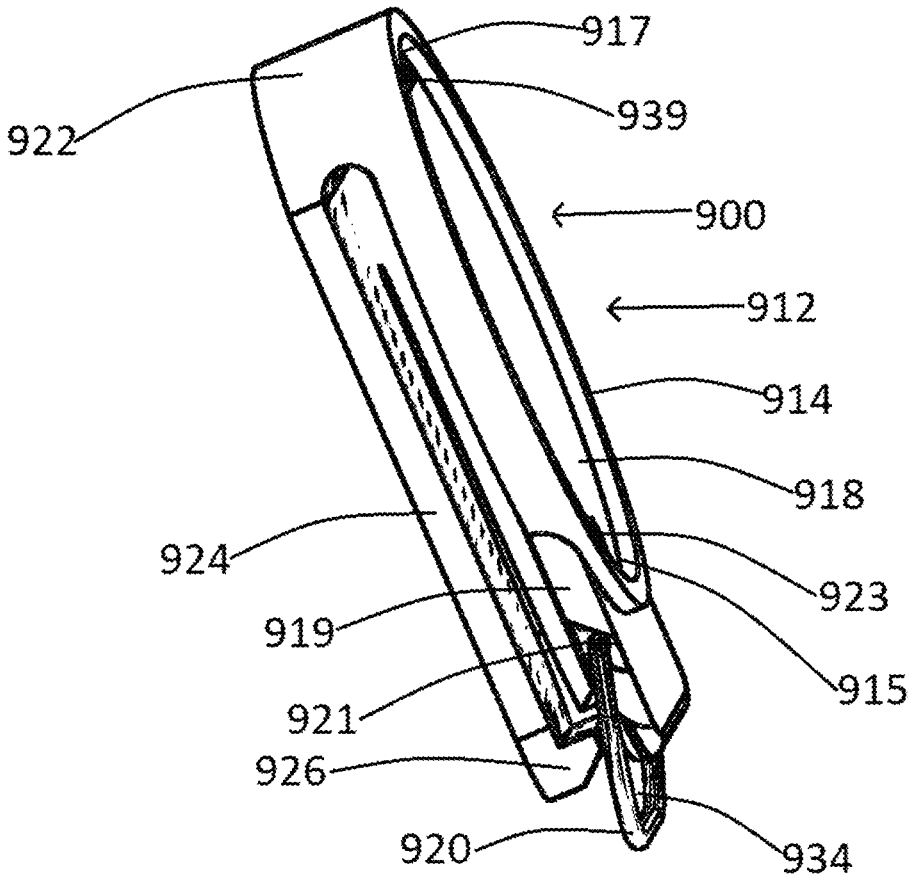
FIG. 50 depicts a side perspective view of the personal effects holder of FIG. 49.

FIGS. 48-49 depict perspective views while FIG. 50 depicts a side view of the personal effects holder or clip, designated 900, and includes body 912 with edge 914 defining face or fascia 918. As illustrated, clip 900 has first end 915 and second end 917.

As shown, face 918 defines an ejector hole 923 and eyebrow hole 939, which may be used to eject an insert or receive a peg on the back of an insert. In at least one embodiment, the clip 900 may be made of any durable material such as plastic, metal and the like. It is understood that the clip 900 may be made entirely of one material, or different parts of the clip 900 may be made of different materials.

FIGS. 48-50 depict clip 900 includes extension 919 on the same plane as body 912 while lip 920 is pivotable about pivot 921, such that lip 920 moves between an functional or open position shown at a predetermined angle to extension 919 (as illustrated in FIG. 48) and a stored or closed position (so that lip 920 is positioned proximate edge of catch 926 as illustrated in FIGS. 49-50). FIGS. 48-50 further illustrate a connecting portion 922 extending from body 912 proximate second end 917. As illustrated, the connecting portion or connector 922 extends in a general direction different from both body 912 and lip 920. A member 924 depends from connecting portion 922 in a direction generally parallel to the face 918 and body 912. As illustrated, the member 924 includes a catch 926.

It should be appreciated that one or more embodiments of the present invention may be used in an emergency. For example, one or more embodiments of the present invention may include a cover having an insert art picture or graphic image, or it could include a device, panic button, camera, microphone, or GPS locator able to communicate with a wireless device such a cell phone for example. A wearer may engage the transmitter sending an emergency signal to the cell phone, by hitting, slapping, yelling and the like.

Embodiments are contemplated for making or using any of the devices described above. The method of using the personal removably securing a holding device to an article of clothing; removably holding the personal effects using the holding device; and displaying an indicia.

Having described the basic concept of the embodiments, it will be apparent to those skilled in the art that the foregoing detailed disclosure is intended to be presented by way of example. Accordingly, these terms should be interpreted as indicating that insubstantial or inconsequential modifications or alterations and various improvements of the subject matter described and claimed are considered to be within the scope and spirt of the disclosed embodiments as recited in the appended claims. Additionally, the recited order of the elements or sequences, or the use of numbers, letters or other designations is not intended to limit the claimed devices or methods to any order except as may be specified. All ranges disclosed herein also encompass any and all possible sub-ranges and combinations of sub-ranges thereof. As utilized herein, the terms "about," "substantially," and other similar terms are intended to have a broad meaning in conjunction with the common and accepted usage by those having ordinary skill in the art to which the subject matter of this disclosure pertains. The embodiments are limited only by the following claims and equivalents thereto. All publications and patent documents cited in this application are incorporated by reference in their entirety for all purposes to the same extent as if each individual publication or patent document were so individually denoted.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

I claim:

1. A personal effects holder device comprising:

a first portion defined on a first plane having a lip defining an aperture forming a holder portion adapted to receive one or more personal effects, the lip further defining at least one opening forming a flexible pass through arrangement, wherein the lip is formed on a second plane different from the first plane; and a depending second portion joined to the first portion via a connector portion, the second portion including a first catch and a second catch adjacent to and on a same plane with the first catch and defining a slot between the first catch and second catch.

2. The personal effects holder device of claim 1 further including a face.

3. The personal effects holder device of claim 2 further including an insert adapted to be received in the face, wherein the insert is removable.

4. The personal effects holder device of claim 3 wherein the insert is rotatable within the face.

5. The personal effects holder device of claim 3 wherein the insert is comprised of a material selected from the group comprising paper, canvas, plastic and a rewriteable material.

6. The personal effects holder device of claim 3 wherein the insert is comprised of a translucent material for light conduction.

7. The personal effects holder device of claim 3 wherein the insert is comprised of a luminescent glow capable material.

8. The personal effects holder device of claim 2 wherein the lip is formed at an angle to at least the face.

9. The personal effects holder device of claim 8 wherein the angle is an 135 degree angle with respect to the face.

10. The personal effects holder device of claim 8 wherein the angle ranges from about 5 degrees to about 175 degrees with respect to the face.

11. The personal effects holder device of claim 2 wherein at least a fraction of the depending second portion is spaced farther from a back of the face than another fraction of the depending second portion.

12. A personal effects holder device comprising:

a body comprising:

a face adapted to display indicia;

an edge extending outward from and around at least portion of the face;

a lip extending from body, the lip further defining at least one slot such that a holder portion forms a flexible pincer-like arrangement;

a connector joined to the body; and a depending portion joined to the connector and extending in a direction substantially parallel to the body, the depending portion comprising:

a first catch; and a second catch.

13. The personal effects holder device of claim 12 wherein the lip defines an aperture forming the holder portion adapted to receive one or more personal effects.

14. The personal effects holder device of claim 12 wherein the lip is formed at an angle to at least the body.

15. The personal effects holder device of claim 12 further comprising the face adapted to receive an insert having the indicia.

16. The personal effects holder device of claim 15 wherein the insert is removable.

17. A personal effects holder device comprising:

a first portion having a lip moveable between and open and closed position and defining an aperture forming a holder portion adapted to receive one or more personal effects, and the lip; and a depending second portion joined to the first portion via a connector portion, the second portion including a first catch and a second catch.

18. A personal effects holder device comprising:

a first portion having a lip defining an aperture forming a holder portion adapted to receive one or more personal effects, the lip further defines at least one slot such that the holder portion forms a flexible pincer-like arrangement; and a depending second portion joined to the first portion via a connector portion, the second portion including a first catch and a second catch.

* * * * *